US010476189B2

(12) United States Patent
Tsubaki

(10) Patent No.: US 10,476,189 B2
(45) Date of Patent: Nov. 12, 2019

(54) CONNECTOR AND MANUFACTURING METHOD OF THE SAME

(71) Applicant: YAZAKI CORPORATION, Tokyo (JP)

(72) Inventor: Akira Tsubaki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/971,033

(22) Filed: May 4, 2018

(65) Prior Publication Data

US 2018/0331446 A1 Nov. 15, 2018

(30) Foreign Application Priority Data

May 10, 2017 (JP) ..... 2017-093685

(51) Int. Cl.
*H01R 12/77* (2011.01)
*H01R 13/52* (2006.01)
*H01R 43/18* (2006.01)

(52) U.S. Cl.
CPC ..... *H01R 12/774* (2013.01); *H01R 12/777* (2013.01); *H01R 13/5208* (2013.01); *H01R 13/5216* (2013.01); *H01R 43/18* (2013.01)

(58) Field of Classification Search
CPC ..... H01R 12/777; H01R 12/778
USPC ..... 439/499, 494, 492
See application file for complete search history.

(56) References Cited

U.S. PATENT DOCUMENTS 4,170,234 A * 10/1979 Graham ..... A61B 18/1402 200/562
4,335,932 A * 6/1982 Herrmann, Jr. ..... B29C 33/0016 174/541
4,433,206 A * 2/1984 Lewis ..... H01R 13/6592 174/359
4,488,768 A * 12/1984 Sigmon ..... H01R 12/675 439/176
5,045,641 A * 9/1991 Urushibata ..... H01R 12/61 174/71 R (Continued)

FOREIGN PATENT DOCUMENTS

CN 102714366 A 10/2012
JP H05-036770 U 5/1993

(Continued)

*Primary Examiner* — Neil Abrams
(74) *Attorney, Agent, or Firm* — Metrolex IP Law Group, PLLC

(57) ABSTRACT

A connector includes: a housing with a fitting portion; a terminal accommodated in the housing, one end side of the terminal being arranged in the fitting portion; a flat cable drawn out of a drawing-out portion of the housing, provided with conductors connected to the other end of the terminal; and a holder integrally provided with the terminal on the other end side of the terminal, accommodated in the drawing-out portion, in which a connection portion of the terminal and the flat cable is arranged. The flat cable is draw out of the drawing-out portion in a direction orthogonal to a fitting direction of the housing. The terminal is placed across the conductors at the connection portion. The drawing-out portion is closed with a sealing material. The sealing material is integrally provided with an inner periphery of the drawing-out portion and an outer periphery of the flat cable.

9 Claims, 18 Drawing Sheets

(56) References Cited

U.S. PATENT DOCUMENTS 5,057,026 A * 10/1991 Sawai ..... H02B 1/207 439/43
5,244,410 A * 9/1993 Demus ..... H01R 12/592 439/497
5,501,612 A * 3/1996 Green ..... H01R 4/70 439/499
5,742,130 A * 4/1998 Korkala ..... H02J 13/0003 315/210
5,997,338 A * 12/1999 Pohjola ..... H01R 12/675 439/425
6,276,960 B1 * 8/2001 Schaefer ..... H01R 11/287 439/466
6,471,365 B2 * 10/2002 Wang ..... F21V 23/06 362/216
7,034,226 B2 * 4/2006 Adachi ..... B23K 20/10 174/88 R
7,207,832 B2 * 4/2007 Liu ..... H01R 9/03 439/499
7,997,931 B2 * 8/2011 Cocquyt ..... H01R 13/521 439/587
8,257,106 B2 * 9/2012 Fornage ..... H01R 13/639 439/304
9,017,094 B2 * 4/2015 Ikeda ..... H01R 12/592 174/117 F
9,257,772 B2 * 2/2016 Natter ..... H01R 13/42
9,356,405 B1 * 5/2016 Skagmo ..... H01R 13/665
9,485,892 B2 * 11/2016 Nakata ..... H01B 7/08
2012/0238155 A1 9/2012 Ikeda
2014/0342587 A1 * 11/2014 Wu ..... H01R 13/447 439/135
2017/0005429 A1 * 1/2017 Tai ..... H01R 9/2491
2018/0331446 A1 * 11/2018 Tsubaki ..... H01R 12/774

FOREIGN PATENT DOCUMENTS

JP H08-180939 A 7/1996
JP 2002-170612 A 6/2002

* cited by examiner

CONNECTOR AND MANUFACTURING METHOD OF THE SAME

CROSS REFERENCE TO RELATED APPLICATIONS

The present application claims priority to Japanese Patent Application No. 2017-093685 filed on May 10, 2017, the entire contents of which are incorporated by reference herein.

BACKGROUND

1. Technical Field

The present invention relates to a connector and a manufacturing method of the same, particularly to a connector having a drawing-out portion of a housing from which a flat cable is drawn out and a manufacturing method of the same.

2. Description of the Related Art

There has been known a conventional connector including: a housing provided with a fitting portion to be fitted with an opponent housing; terminals accommodated in the housing, one ends of which are disposed at the fitting portion; a flexible printed circuit as a flat cable drawn out of a joint part housing hole as a drawing-out portion of the housing toward the outside, including conductors connected with the other ends of the terminals, the conductors formed along a longitudinal direction and arranged in a width direction; and a holder in which a connecting portion of the terminals and the flexible printed circuit is arranged, accommodated in the joint part housing hole, and integrally provided with the other ends of the terminals (see JP 2002-170612 A (Patent Literature 1)).

In the aforementioned connector, a resin mold part is provided in the connection portion of the terminals and the flexible printed circuit. Accordingly, the connection portion is not exposed to the outside, and the waterproof performance is maintained.

There has been known another conventional connector including a holder provided with an elastic member pressing a flat cable to an inner surface of a drawing-out portion of a housing (see JP H08-180939 A (Patent Literature 2)).

In the aforementioned connector, by accommodating the holder in the drawing-out portion of the housing, even if the flat cable is pressed to the inner surface of the drawing-out portion by the elastic member and an external force is applied to the flat cable, it is possible to prevent the external force from directly applied to a connection portion side.

SUMMARY

In the connector disclosed in Patent Literature 1, the airtightness between the holder and the drawing-out portion of the housing is low, and there is a possibility that water or the like may intrude into the drawing-out portion from the flat cable side.

In the connector disclosed in Patent Literature 2, since the flat cable is pressed to the inner surface of the drawing-out portion of the housing by the elastic member of the holder, the airtightness between the drawing-out portion and the holder is increased to some extent. However, the pressing force of the elastic member is low in the waterproof function, and the waterproof performance on the drawing-out portion side is insufficient.

In the connectors disclosed in Patent Literatures 1 and 2, the flat cable, in which conductors are formed along the longitudinal direction and arranged in the width direction, is drawn out of the drawing-out portion of the housing toward a fitting direction of the housing and the opponent housing.

However, when the flat cable is drawn toward the fitting direction of the housing and the opponent housing, a single terminal is required to be arranged at a corresponding single conductor in the flat cable.

With this, when it is desired to connect a single terminal to plural conductors in the flat cable by circuit design, the terminal is required to have a complicated shape, and such situation has deteriorated the free design of circuit.

It is therefore an object of the present invention to provide a connector and a manufacturing method of a connector which can improve the waterproof performance of a drawing-out portion side of a housing and can improve the free design of circuit.

A first aspect of the present invention is a connector including: a housing including a fitting portion capable of being fitted with an opponent housing; at least one terminal accommodated in the housing, one end side of the at least one terminal being arranged in the fitting portion; at least one flat cable drawn out of a drawing-out portion of the housing, provided with conductors connected to the other end of the at least one terminal, the conductors being formed along a longitudinal direction of the at least one flat cable and arranged in a width direction of the at least one flat cable; and at least one holder integrally provided with the at least one terminal on the other end side of the terminal, accommodated in the drawing-out portion, in which a connection portion of the at least one terminal and the at least one flat cable is arranged; wherein the at Least one flat cable is draw out of the drawing-out portion in a direction orthogonal to a fitting direction in which the housing and the opponent housing are fitted with each other, the at least one terminal is placed across the conductors at the connection portion, the drawing-out portion is closed with a sealing material through which the at least one flat cable is inserted, and the sealing material is integrally provided with an inner periphery of the drawing-out portion and an outer periphery of the at least one flat cable.

The at least one terminal may include a plurality of terminals arranged in the at least one holder, and the sealing material may be disposed between the adjacent terminals.

A first sealing material covering the connection portion may be integrally provided with the at least one holder around the connection portion in the at least one holder.

The at least one holder may include a plurality of holders accommodated in the drawing-out portion, and the first sealing material may be integrally provided with the plurality of holders around the plurality of holders to hold the plurality of holders.

The sealing material may include the first sealing material, and the first sealing material may be formed to be capable of closing the drawing-out portion and to be capable of being welded to the inner periphery of the drawing-out portion.

A second sealing material being capable of closing the drawing-out portion and being capable of being welded to the inner periphery of the drawing-out portion may be integrally provided with the at least one flat cable around the at least one flat cable.

The at least one flat cable may include a plurality of flat cables drawn out of the drawing-out portion, and the second sealing material may be integrally provided with the plurality of flat cables around the plurality of flat cables to hold the plurality of flat cables.

The sealing material may include the second sealing material.

A sealing member partitioning the housing into a side of the fitting portion and a side of the drawing-out portion may be provided between the housing and the at least one holder.

A second aspect of the present invention is a manufacturing method of a connector including: a housing including a fitting portion capable of being fitted with an opponent housing; at least one terminal accommodated in the housing, one end side of the at least one terminal being arranged in the fitting portion; a flat cable drawn out of a drawing-out portion of the housing, provided with conductors connected to the other end of the at least one terminal, the conductors being formed along a longitudinal direction of the flat cable and arranged in a width direction of the flat cable; and a holder integrally provided with the at least one terminal on the other end side of the at least one terminal, accommodated in the drawing-out portion, in which a connection portion of the at least one terminal and the flat cable is arranged. The method includes:

integrally forming the at least one terminal and the holder so that one end side of the at least one terminal is exposed to an outside of the housing and the other end side of the at least one terminal is located in an inside of the housing;

arranging the flat cable into the holder so that the other end side of the at least one terminal is placed across the conductors;

connecting a predetermined terminal of the at least one terminal and a predetermined conductor of the conductors of the flat cable to form the connection portion;

accommodating the holder into the drawing-out portion of the housing;

drawing the flat cable out of the drawing-out portion toward the outside of the housing in a direction orthogonal to a fitting direction in which the housing and the opponent housing are fitted with each other; and integrally forming a sealing material with an inner periphery of the drawing-out portion and an outer periphery of the flat cable by filling the sealing material into the drawing-out portion to close the drawing-out portion.

A third aspect of the present invention is a manufacturing method of a connector including: a housing including a fitting portion capable of being fitted with an opponent housing; at least one terminal accommodated in the housing, one end side of the at least one terminal being arranged in the fitting portion; a flat cable drawn out of a drawing-out portion of the housing, provided with conductors connected to the other end of the at least one terminal, the conductors being formed along a longitudinal direction of the flat cable and arranged in a width direction of the flat cable; and a holder integrally provided with the at least one terminal on the other end side of the at least one terminal, accommodated in the drawing-out portion, in which a connection portion of the at least one terminal and the flat cable is arranged. The method includes:

integrally forming the at least one terminal and the holder so that one end side of the at least one terminal is exposed to an outside of the housing and the other end side of the at least one terminal is located in an inside of the housing;

arranging the flat cable into the holder so that the other end side of the at least one terminal is placed across the conductors;

connecting a predetermined terminal of the at least one terminal and a predetermined conductor of the conductors of the flat cable to form the connection portion;

integrally forming a first sealing material with the holder around the connection portion in the holder, the first sealing material covering the connection portion and being capable of closing the drawing-out portion and being welded to an inner periphery of the drawing-out portion;

accommodating the holder into the drawing-out portion of the housing;

drawing the flat cable out of the drawing-out portion toward the outside of the housing in a direction orthogonal to a fitting direction in which the housing and the opponent housing are fitted with each other; and welding the first sealing material and the inner periphery of the drawing-out portion.

A fourth aspect of the present invention is a manufacturing method of a connector including: a housing including a fitting portion capable of being fitted with an opponent housing; at least one terminal accommodated in the housing, one end side of the at least one terminal being arranged in the fitting portion; a flat cable drawn out of a drawing-out portion of the housing, provided with conductors connected to the other end of the at least one terminal, the conductors being formed along a longitudinal direction of the flat cable and arranged in a width direction of the flat cable; and a holder integrally provided with the at least one terminal on the other end side of the at least one terminal, accommodated in the drawing-out portion, in which a connection portion of the at least one terminal and the flat cable is arranged. The method includes:

integrally forming the at least one terminal and the holder so that one end side of the at least one terminal is exposed to an outside of the housing and the other end side of the at least one terminal is located in an inside of the housing;

arranging the flat cable into the holder so that the other end side of the at least one terminal is placed across the conductors;

connecting a predetermined terminal of the at least one terminal and a predetermined conductor of the conductors of the flat cable to form the connection portion;

integrally forming a second sealing material with the flat cable around the flat cable, the second sealing material covering the connection portion and being capable of closing the drawing-out portion and being welded to an inner periphery of the drawing out portion;

accommodating the holder into the drawing-out portion of the housing;

drawing the flat cable out of the drawing-out portion toward the outside of the housing in a direction orthogonal to a fitting direction in which the housing and the opponent housing are fitted with each other; and welding the second sealing material and the inner periphery of the drawing-out portion.

According to the present invention, it is possible to provide a connector and a manufacturing method of a connector which can improve the waterproof performance of a drawing-out portion side of a housing and can improve the free design of circuit.

DESCRIPTION OF THE EMBODIMENTS

Figure 1:
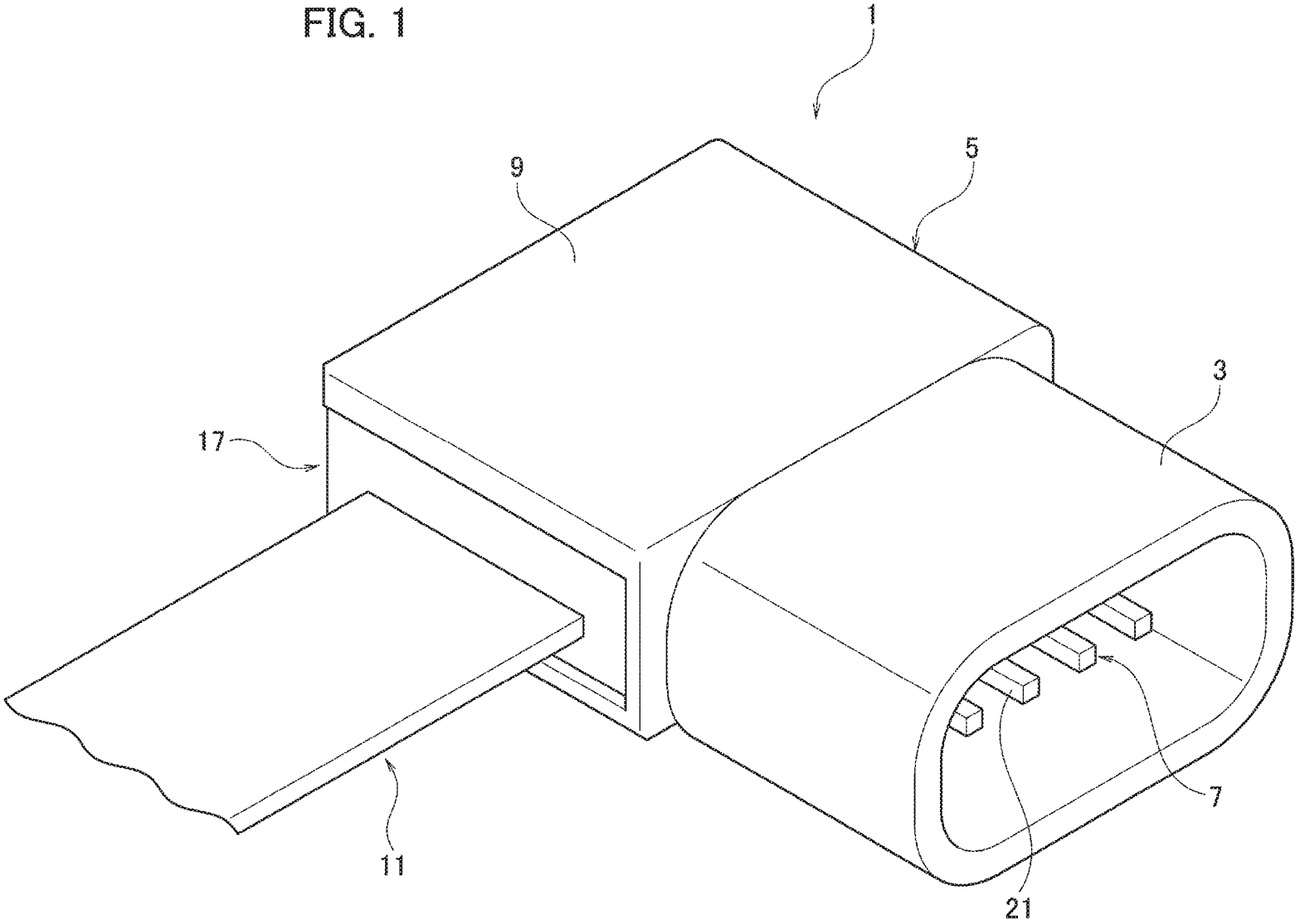
FIG. 1 is a perspective view of a connector according to a first embodiment of the present invention.
Figure 2:
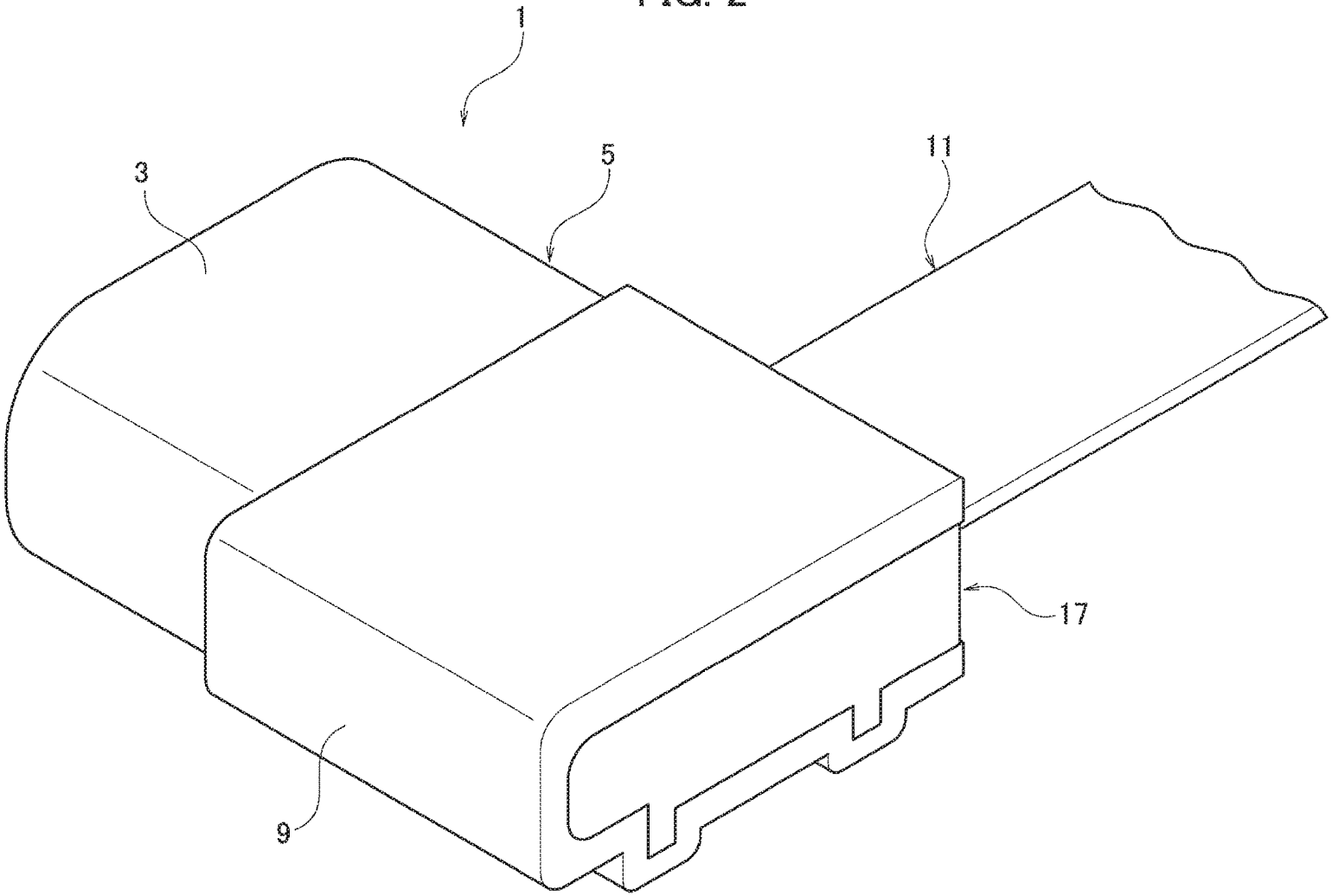
FIG. 2 is a perspective view of the connector shown in FIG. 1 when viewed from the rear side.
Figure 3:
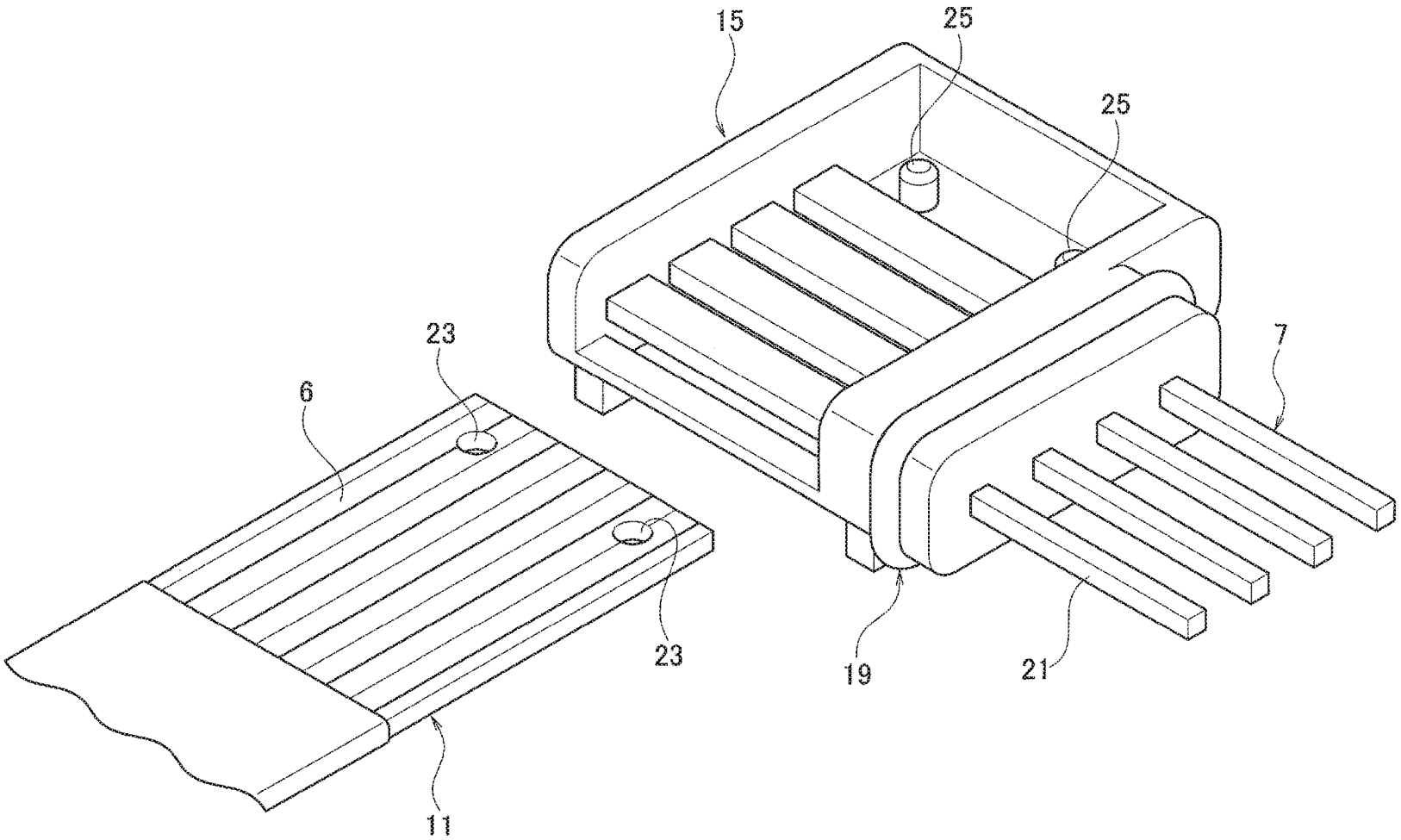
FIG. 3 is a perspective view showing a state where a flat cable is inserted into a holder of the connector according to the first embodiment of the present invention.
Figure 4:
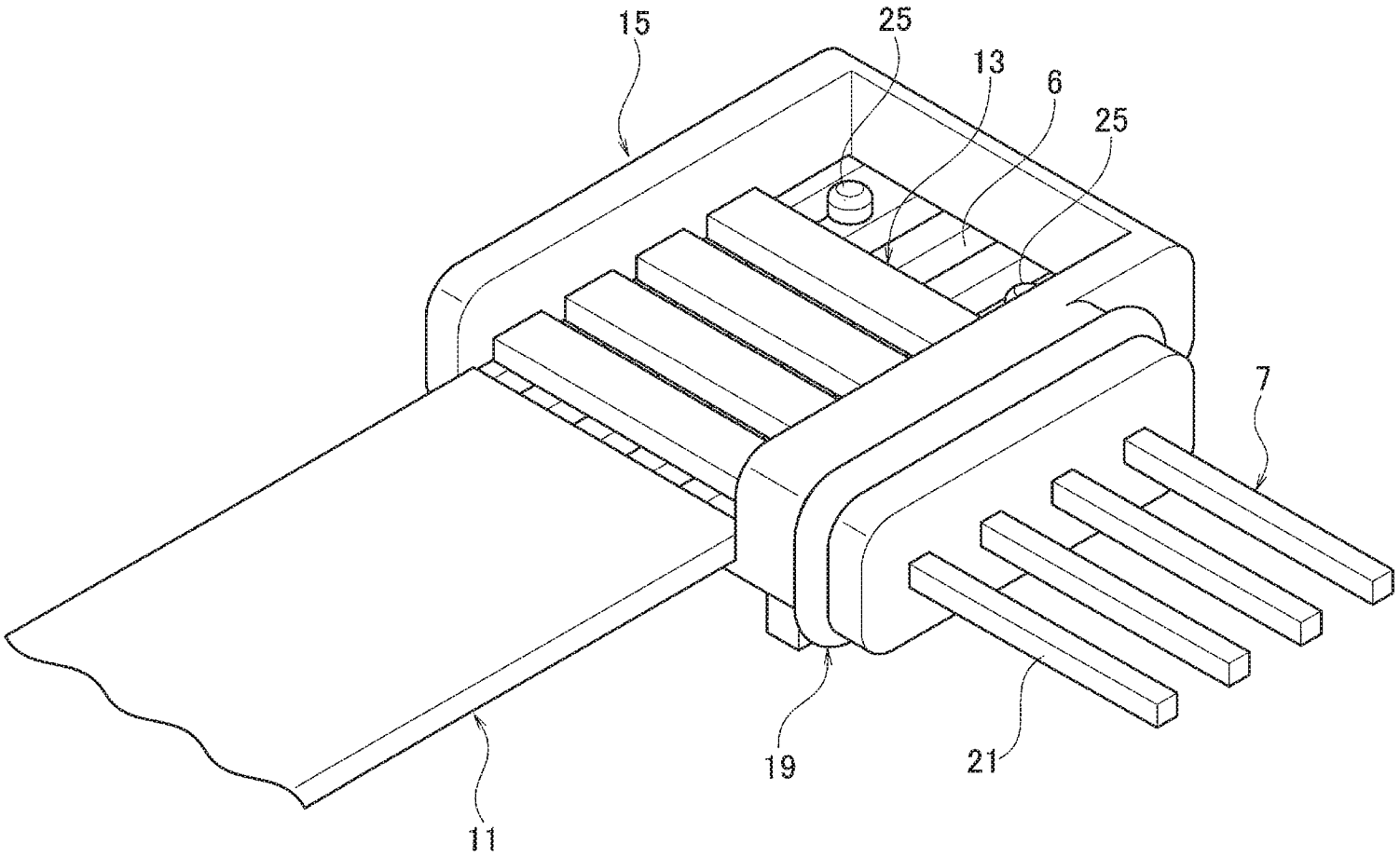
FIG. 4 is a perspective view showing a state where the flat cable is assembled to the holder of the connector according to the first embodiment of the present invention.
Figure 5:
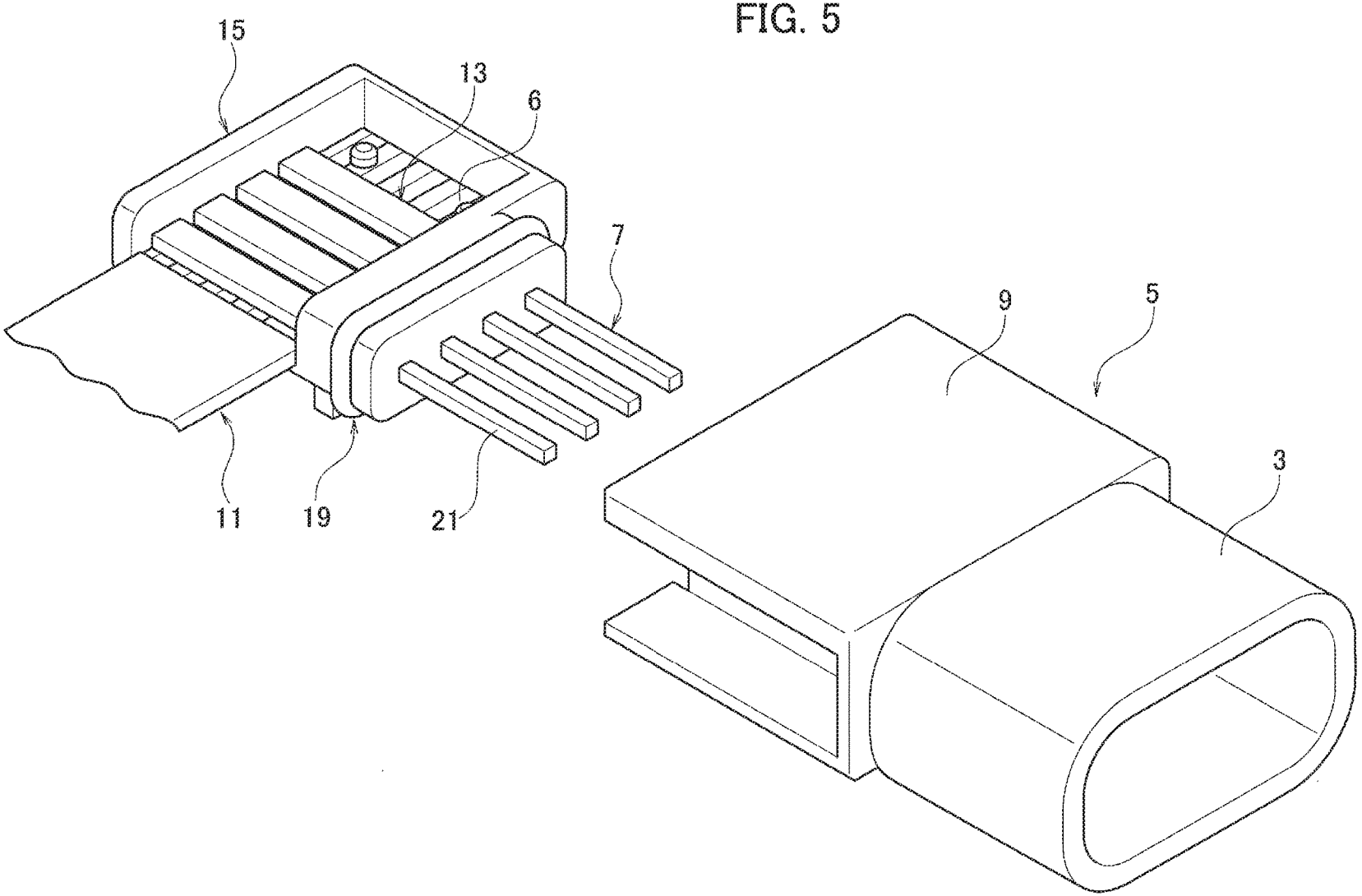
FIG. 5 is a perspective view showing a state where a holder is accommodated in a housing of the connector according to the first embodiment of the present invention.
Figure 6:
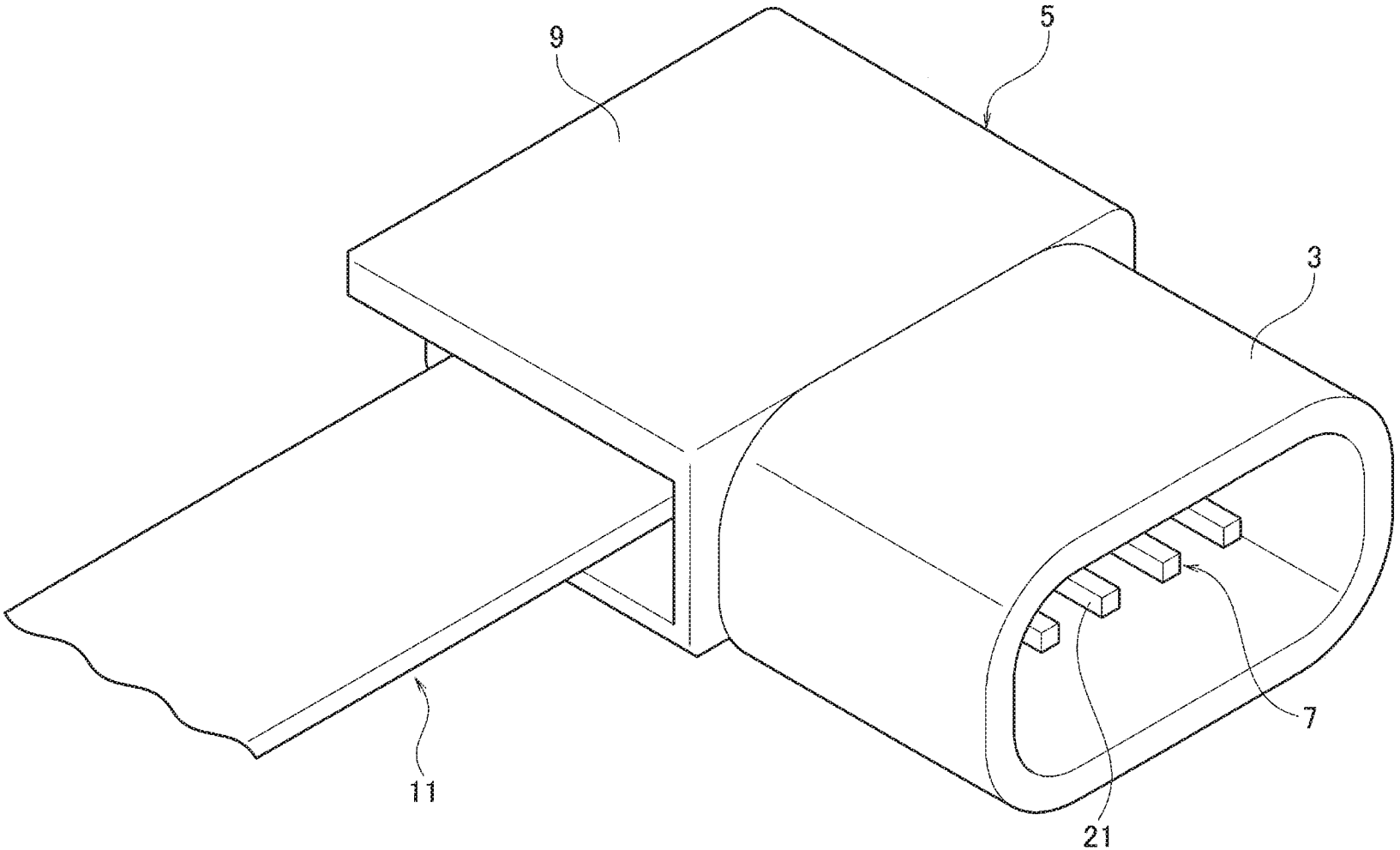
FIG. 6 is a perspective view showing a state where the holder is accommodated in the housing of the connector according to the first embodiment of the present invention.
Figure 7:
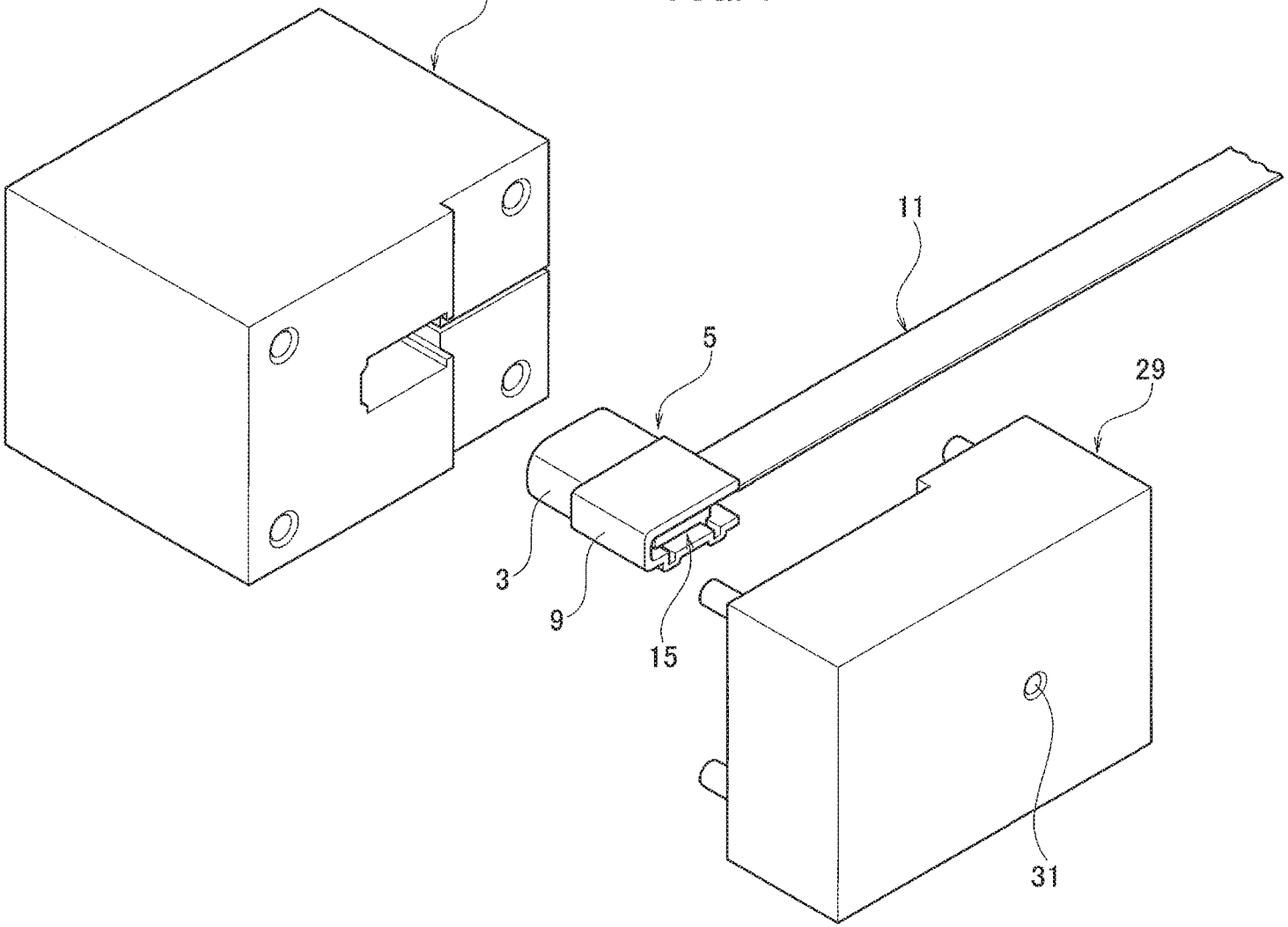
FIG. 7 is a perspective view showing a state where the housing of the connector according to the first embodiment of the present invention is arranged in a die.

A connector and a connector manufacturing method according to embodiments of the present invention will be described with reference to FIGS. 1 to 18. Note that, in any embodiments, at least one terminal 7, at least one flat cable 11, and at least one holder are provided. In the description as described below, plural terminals 7 are occasionally supposed to be provided for convenience of explanation.

First Embodiment

A first embodiment will be described with reference to FIGS. 1 to 8.

A connector 1 according to the present embodiment includes: a housing 5 including a fitting portion 3 capable of being fitted with an opponent housing; terminals 7 accommodated in the housing 5, one end side of each terminal 7 being arranged in the fitting portion 3; a flat cable 11 drawn out of a drawing-out portion 9 of the housing 5, provided with conductors connected to the other end of each terminal 7, the conductors being formed along a longitudinal direction of the flat cable 11 and arranged in a width direction of the flat cable 11; and a holder 15 integrally provided with the terminal 7 on the other end side of each terminal 7, accommodated in the drawing-out portion 9, in which a connection portion 13 of the terminals 7 and the flat cable 11 is arranged. The flat cable 11 is draw out of the drawing-out portion 9 in a direction orthogonal to a fitting direction in which the housing 5 and the opponent housing are fitted with each other. Each terminal 7 is placed across the conductors 6 at the connection portion 13. The drawing-out portion 9 is closed with an elastic sealing material 17 as a sealing material through which the flat cable 11 is inserted. The elastic sealing material 17 is integrally provided with an inner periphery of the drawing-out portion 9 and an outer periphery of the flat cable 11.

The terminals 7 are arranged in the holder 15. The elastic sealing material 17 is disposed between the adjacent terminals 7, 7.

A sealing member 19 is provided between the housing 5 and the holder 15. The sealing member 19 partitions the housing 5 into a fitting portion 3 side and a drawing-out portion 9 side.

In a manufacturing method of the connector 1, the following processes are performed. The terminals 7 are integrally formed with the holder 15 so that one end side of each terminal 7 is exposed to an outside of the housing 5 and the other end side of each terminal 7 is located in an inside of the housing 5. The flat cable 11 is arranged into the holder 15 so that the other end side of each terminal 7 is placed across the conductors 6. A predetermined terminal 7 of the terminals 7 and a predetermined conductor 6 of the conductors 6 of the flat cable 11 are connected with each other to form the connection portion 13. The holder 15 is accommodated into the drawing-out portion 9 of the housing 5. The flat cable 11 is drawn out of the drawing-out portion 9 toward the outside of the housing 5 in a direction orthogonal to a fitting direction in which the housing 5 and the opponent housing are fitted with each other. The elastic sealing material 17 is integrally formed with an inner periphery of the drawing-out portion 9 and an outer periphery of the flat cable 11 by filling the elastic sealing material 17 into the drawing-out portion 9 to close the drawing-out portion 9.

The terminal(s) 7 is/are integrally formed with the holder before the connection portion 13 is formed.

Before the holder 15 is accommodated in the drawing-out portion 9, the sealing member 19 is put on an outer periphery of the holder 15.

As shown in FIGS. 1 to 8, the housing 5 is made of insulating material such as synthetic resin or the like. The housing 5 includes the fitting portion 3 and the drawing-out portion 9.

The fitting portion 3 is formed to be fitted with an opponent housing (not shown) which houses an opponent terminal (not shown). The fitting portion 3 opens on one side of the housing 5.

One end side of each terminal 7 is arranged in the fitting portion 3, and is electrically connected with the opponent terminal when the housing 5 is fitted with the opponent housing.

The drawing-out portion 9 and the fitting portion continuously formed of a single member (as a single structure).

An opening of the drawing-out portion 9 is formed so that the holder 15 is accommodated in the drawing-out portion 9 while the holder 15 is directed in the fitting direction of the housing 5 and the opponent housing. In addition, the opening is formed so that the flat cable 11 is drawn out of the drawing-out portion 9 in a direction orthogonal to the fitting direction.

The other end side of each terminal 7 is arranged in the drawing-out portion 9, and is electrically connected with the flat cable 11 via the connection portion 13. The flat cable 11 is drawn out of the drawing-out portion 9 to the outside of the housing 5.

Each terminal 7 is made of electrically conductive material, and is formed into a linear shape. Each terminal 7 has a tab-like shaped terminal portion 21 on one end side, and flat-shaped (bar-shaped) portion on the other end side serving as a connection portion 13.

The plural (e.g. four) terminals 7 are arranged in parallel and the middle portions of them are integrally molded (formed) with the holder 15 by insert molding.

The terminal portions 21 of the terminals 7 are arranged in the fitting portion 3 of the housing 5. The connection portions 13 of the terminals 7 are arranged in the holder 15 which is accommodated in the drawing-out portion 9 of the housing 5. The terminals 7 are electrically connected with the flat cable 11 via the connection portions 13.

The flat cable 11 is a flexible and flat cable such as so-called flexible flat cable (FFC), flexible printed circuit (FPC), a ribbon cable and the like. The flat cable 11 includes conductors formed along the longitudinal direction of the flat cable 11 and arranged (arrayed) in the width direction of the flat cable 11.

One end side of the flat cable 11 is electrically connected to a device. The other end side of the flat cable 11 is arranged on the other ends of the terminals 7 and serves as (i.e. forms) the connection portion 13 electrically connected with the terminals 7 by use of connection means such as welding or the like.

The connection portion 13 of the flat cable 11 and the terminals 7 is arranged in the holder 15 which is accommodated in the drawing-out portion 9 of the housing 5.

The holder 15 is made of insulating material such as synthetic resin or the like. The holder 15 is integrally molded (formed) with the terminals 7 by insert molding so that the connection portion 13 and the terminal portions 21 of the terminals 7 are exposed to the outside.

In a state where the holder 15 is accommodated in the drawing-out portion 9 of the housing 5, the terminal portion 21 of the terminal 7 is exposed toward the fitting portion 3 side, and the flat cable 11 is drawn out toward a direction orthogonal to the fitting direction.

An end of the flat cable 11 is inserted between the terminals 7 and a bottom wall of the holder 15. The terminals 7 and the flat cable 11 are electrically connected to each other by connecting mean such as welding, whereby the connection portion 13 of the terminals 7 and the flat cable 11 is formed.

The bottom wall of the holder 15 has projections 25 (e.g. two projections) at a position where the end of the flat cable 11 inserted in the holder 15 is positioned. The projections 25 are inserted into holes formed in the end of the flat cable 11, whereby the flat cable 11 is held to the holder 15.

The conductors 6 of the flat cable 11, which is drawn out in a direction orthogonal to a direction from the drawing-out portion 9 to the fitting portion 3, in other words, in a direction orthogonal to the fitting direction of the housing 5 and the opponent housing, are placed across the other end sides of the terminals 7.

If the flat cable would be drawn out from the drawing-out portion 9 in the fitting direction of the housing 5 and the opponent housing, each of the other end sides of the terminals 7 would be disposed facing only one of any conductors 6 of the flat cable 11.

In this case, one of the terminals 7 can only be connected or disconnected to corresponding one of the conductors 6. That is, it is impossible to selectively connect one terminal 7 with any of the conductors 6, and to deal with multiple circuit designs.

In contrast, according to the present embodiment, one terminal 7 is placed across the plurality of conductors 6. Therefore, it is possible to selectively connect one terminal 7 with any of the conductors 6, and to improve the free design of circuit.

The terminals 7 are integrally provided with the holder 15. Therefore, it is possible to selectively connect each of the terminals 7 with a predetermined conductor(s) of the conductors 6, and to deal with further complicated circuits, thereby further improving the free design of circuit.

The holder 15, in which the flat cable 11 is assembled at the connection portion 13, is accommodated in the drawing-out portion 9 of the housing 5. The flat cable 11 is drawn out of the drawing-out portion 9 of the housing 5 in the direction orthogonal to the fitting direction of the housing 5 and the opponent housing.

The elastic sealing material 17 is filled in the drawing-out portion 9 of the housing 5 from which the flat cable 11 is drawn out, and thus the opening of the drawing-out portion 9 is closed.

The elastic sealing material 17 as a sealing material is made of an elastic material such as a thermoplastic polyester elastomer resin. The elastic sealing material 17 is filled in the drawing-out portion 9 of the housing 5 by injection molding, closes the drawing-out portion 9, and waterproofs the inside of the housing 5.

The housing 5 is set in combined dies 27, 29 while the holder 15 is accommodated in the drawing-out portion 9 of the housing 5. Thereafter, the elastic sealing material 17 is injected through an inlet 31 of the die 29, and filled in the drawing-out portion 9 of the housing 5.

The elastic sealing material 17 thus filled in the drawing-out portion 9 of the housing 5 adheres to an inner periphery of the drawing-out portion 9, an outer periphery of the flat cable 11 and an outer periphery of the holder 15. The elastic sealing material 17 is disposed between the adjacent terminals 7 and 7, closes the opening of the drawing-out portion 9, and seals a drawing-out portion 9 side of the housing 5.

The drawing-out portion 9 is closed by filling of the elastic sealing material 17 into the drawing-out portion 9 of the housing 5. Accordingly, it is possible to improve air tightness among the housing 5, the flat cable 11 and the holder 15, and to securely prevent water intrusion or the like from a flat cable 11 side.

The elastic sealing material 17 is elastic. Accordingly, it is possible to suppress a generation of a gap caused of difference in coefficient of thermal expansions of the housing 5, the terminals 7, the flat cable 11 and the holder 15, and to maintain a waterproof function even in a variation of ambient temperature.

As described above, the elastic sealing material 17 adheres to an inner periphery of the drawing-out portion 9, an outer periphery of the flat cable 11 and an outer periphery of the holder 15. Accordingly, without providing the drawing-out portion 9, the flat cable 11 and the holder 15 with a fixing means for engaging with each other, it is possible to prevent the flat cable 11 and the holder 15 from coming off, whereby reducing the number of parts and simplifying the structure.

As described above, the elastic sealing material 17 is disposed between the adjacent terminals 7, 7. Accordingly, the housing 5 and the holder do not have to have a partitioning means such as a partition wall to maintain electrical insulation between the adjacent terminals 7, 7. That is, it is possible to maintain electrical insulation between the adjacent terminals 7, 7 while reducing the number of parts and simplifying the structure.

On the fitting portion 3 side of the holder 15, the sealing member 19 made of a packing is closely contact with the outer periphery of the holder 15.

In a state where the holder 15 is accommodated in the drawing-out portion 9 of the housing 5, the sealing member 19 closely contacts with the inner periphery of the housing 5, and partitions the inside of the housing 5 into the fitting portion 3 side and the drawing-out portion 9 side.

By providing the sealing member 19, it is possible to prevent the elastic sealing material 17 injected into the drawing-out portion 9 of the housing 5 from leaking to the fitting portion 3 side when the elastic sealing material 17 is injection-molded, and to prevent the elastic sealing material 17 from adhering to the terminal portion 21 of each terminal 7.

Since the sealing member 19 partitions the inside of the housing 5 into the fitting portion 3 side and the drawing-out portion 9 side, it is possible to prevent water intrusion or the like from the fitting portion 3 side, and to improve waterproofness.

In the manufacturing method of the connector 1, firstly, the terminals 7 are arranged in parallel, the terminals 7 and the holder 15 are integrally formed by injection molding so that one end sides of the terminals 7 are exposed to the outside of the housing 5 and the other end side of the terminals 7 are located in the inside of the housing 5.

Next, the sealing member 19 is mounted on the outer periphery of the holder 15 on the fitting portion 3 side, and an end of the flat cable 11 is inserted into and arranged in the holder 15 so that the other end sides of the terminals 7 are placed across the conductors 6.

Next, by use of connection means such as welding or the like, a predetermined terminal 7 of the terminals 7 and a predetermined conductor 6 of the conductors 6 of the flat cable 11 are connected to form the connection portion 13.

Next, the holder 15 is inserted into the drawing-out portion 9 of the housing 5 toward the fitting direction of the housing 5 and the opponent housing and is accommodated in the drawing-out portion 9. The flat cable 11 is drawn out of the drawing-out portion 9 toward the outside of the housing 5 in the direction orthogonal to the fitting direction of the housing 5 and the opponent housing.

The housing 5 with the holder 15 accommodated therein is set in the combined dies 27, 29, and the elastic sealing material 17 is filled in the drawing-out portion 9 of the housing 5 by injection molding. Finally, the elastic sealing material 17 closes the drawing-out portion 9 and is integrally formed with the inner periphery of the drawing-out portion 9 and the outer periphery of the flat cable 11.

The elastic sealing material 17 filled in the drawing-out portion 9 is disposed between the adjacent two of the terminals 7.

In the connector 1, the flat cable 11 is draw out of the drawing-out portion 9 in a direction orthogonal to a fitting direction of the housing 5 and the opponent housing, and the terminal 7 is placed across the conductors 6 at the connection portion 13. Accordingly, it is possible to arrange the terminal 7 having a simple form so that it can be connected with the plural conductors 6.

Therefore, without complicating the form of the terminal 7, it is possible to selectively connect one terminal 7 with any of the conductors 6 depending on the circuit design, and to improve the free design of circuit.

As described above, the drawing-out portion 9 is closed with the elastic sealing material 17 through which the flat cable 11 is inserted. The elastic sealing material 17 is integrally provided with the inner periphery of the drawing-out portion 9 and the outer periphery of the flat cable 11. Accordingly, it is possible to hermetically seal the drawing-out portion 9 with the flat cable 11 drawn therefrom by the elastic sealing material 17, and to prevent water intrusion or the like from the flat cable 11 side to the drawing-out portion 9.

As described above, the elastic sealing material 17 integrally provided with the inner periphery of the drawing-out portion 9 and the outer periphery of the flat cable 11. Accordingly, the housing 5 do not have to have a fixing means for fixing the flat cable 11 and the holder 15. Thus, it is possible to reduce the number of parts and to simplify the structure of the drawing-out portion 9.

In the connector 1, it is possible to improve waterproofness of the drawing-out portion 9 side of the housing 5 and to improve the free design of circuit.

The plural terminals 7 are arranged in the holder 15. Accordingly, with selecting connections between any the terminals and any of the conductors 6, it is possible to deal with complicated circuit designs and to further improve the free design of circuit.

As described above, the elastic sealing material 17 is disposed between the adjacent terminals 7, 7. Accordingly, the housing 5 and the holder do not have to have a partitioning means such as a partition wall to maintain electrical insulation between the adjacent terminals 7, 7. That is, it is possible to maintain electrical insulation between the adjacent terminals 7, 7.

The sealing member 19 is provided between the housing 5 and the holder 15, and partitions the housing 5 into the fitting portion side and the drawing-out portion 9 side. Accordingly, it is possible to prevent water intrusion or the like from the fitting portion 3 side, and to improve waterproofness.

In the manufacturing method of the connector 1, the flat cable 11 is arranged in the holder 15 so that the other end sides of the terminals 7 are placed across the conductors 6, a predetermined terminal 7 of the terminals 7 and a predetermined conductor 6 of the conductors 6 of the flat cable 11 is connected to form the connection portion 13. Therefore, without complicating the form of the terminal 7, it is possible to selectively connect one terminal 7 with any of the conductors 6 depending on the circuit design, and to improve the free design of circuit.

The elastic sealing material 17 is filled in the drawing-out portion 9 to close the drawing-out portion 9 and the elastic sealing material 17 is integrally formed with the inner periphery of the drawing-out portion 9 and the outer periphery of the flat cable 11. Accordingly, it is possible to hermetically seal the drawing-out portion 9 with the flat cable 11 drawn therefrom by the elastic sealing material 17, and to prevent water intrusion or the like from the flat cable 11 side to the drawing-out portion 9.

The elastic sealing material 17 is integrally provided with the inner periphery of the drawing-out portion 9 and the outer periphery of the flat cable 11. Accordingly, is not required to provide the housing 5 with a fixing means for fixing the flat cable 11 and the holder 15. Thus, it is possible to reduce the number of parts and to simplify the structure of the drawing-out portion 9.

In the manufacturing method as described above, it is possible to improve waterproofness of the drawing-out portion 9 side of the housing 5 and to improve the free design of circuit.

The plural terminals 7 are integrally formed with the holder 15, and a predetermined terminal 7 of the terminals 7 and a predetermined conductor 6 of the conductors 6 of the flat cable 11 is connected to form the connection portion 13. Accordingly, it is possible to deal with complicated circuit designs and to further improve the free design of circuit.

The elastic sealing material 17 is disposed between the adjacent terminals 7, 7. Accordingly, it is not required to provide the housing 5 and the holder with a partitioning means such as a partition wall to maintain electrical insulation between the adjacent terminals 7, 7. Nevertheless, it is possible to maintain electrical insulation between the adjacent terminals 7, 7.

The sealing member 19 is provided between the housing 5 and the holder 15 to partition the housing 5 into the fitting portion 3 side and the drawing-out portion 9 side. Accordingly, it is possible to prevent water intrusion or the like from the fitting portion 3 side, and to improve waterproofness.

Second Embodiment

A second embodiment will be described with reference to FIGS. 9 to 13.

In a connector 101 according to the present embodiment, a first sealing material 103 covering the connection portion 13 is integrally provided with the holder 15 around the connection portion 13 in the holder 15.

Plural holders 15 are accommodated in the drawing-out portion 9. The first sealing material 103 is integrally provided with the holders 15 around the holders 15 to hold the holders 15.

In a manufacturing method of the connector 101, before the holders 15 are accommodated in the drawing-out portion 9, the first sealing material 103 covering the connection portion 13 is integrally formed with the holder 15 around the connection portion 13 in the holder 15.

Further, before the holders 15 are accommodated in the drawing-out portion 9, the holders 15, in each of which the connection portion 13 is formed, are stacked to each other, and the first sealing material 103 is integrally formed with the stacked holders 15 around them.

Note that the same reference numerals are used to designate the same components as those of the first embodiment, and the description of the configuration and the function will be omitted by referring to the description about the first embodiment. However, since the configuration is the same as that of the first embodiment, the effect thus obtained is the same.

As shown in FIGS. 9 to 13, the plural (e.g. two) holders 15 are accommodated in the drawing-out portion 9 of the housing 5 while the holders 15 are stacked.

In each holder 15, the plural (e.g. four) terminals 7 are arranged in parallel and the middle portions of them are integrally molded (formed) with the holder 15 by insert molding.

The flat cable 11 is arranged in each holder 15 which is integrally provided with terminals 7. While the holders 15 are accommodated in the drawing-out portion 9 of the housing 5, plural (e.g. two) flat cables 11 are drawn out of the drawing-out portion 9.

In a state where the holders 15 are stacked to each other, the first sealing material 103 is integrally provided with the stacked holders 15 around the connection portions 13 of the terminals 7 and the flat cables 11

The first sealing material 103 is made of insulating material such as synthetic resin or the like. By injection molding, the first sealing material 103 is integrally formed with the holders 15 around a part of the holders 15 where the connection portions 13 are located.

The stacked holders 15 are set in the combined dies 107, 109 together with cores 105. Thereafter, the first sealing material 103 is injected through an inlet 111 of the die 107, and is integrally molded (formed) with the stacked holders 15 around them.

The first sealing material 103 is disposed between the adjacent terminals 7, 7 in the connection portion 13, and maintains electrical insulation between the adjacent terminals 7, 7.

The first sealing material 103 is provided around the connection portion 13 in the holder 15. Accordingly, it is possible to securely prevent water intrusion or the like to the connection portion 13 of the terminals 7 and the flat cable 11, whereby improving connection reliability between the terminals 7 and the flat cable 11.

The first sealing material 103 is located around the stacked holders 15, and is integrally provided with the stacked holders 15. Therefore, the holders 15 can be treated as a single member, the holders 15 can be collectively accommodated in the drawing-out portion 9 of the housing 5, and it is possible to improve the assembling performance of the holders 15 to the housing 5.

The first sealing material 103 is integrally molded with the outer periphery of the holders 15 on the fitting portion 3 side. This part has a sealing function which partitions the inside of the housing 5 into the fitting portion 3 side and the drawing-out portion 9 side. Therefore, the sealing member 19 (see FIG. 3) can be omitted.

In a manufacturing method of the connector 101, firstly, the holders 15, in each of which the flat cable 11 is assembled and the predetermined terminal 7 and the predetermined conductor 6 (see FIG. 3) are connected to each other to form the connection portion 13, are stacked, and set in the combined dies 107, 109 together with the cores 105.

Next, by injection molding, the first sealing material 103 is injected around the connection portions 13 in the holders 15 to cover the connection portions 13 and is integrally formed with the holders 15 around holders 15 to be capable of closing the drawing-out portion 9.

Next, the holders 15 with which the first sealing material 103 is integrally molded are inserted into and accommodated in the drawing-out portion 9 of the housing 5 in a state where the holders 15 are directed in the fitting direction of the housing 5 and the opponent housing, and the flat cables 11 are drawn out of the drawing-out portion 9 to the outside of the housing 5 in the direction orthogonal to the fitting direction of the housing 5 and the opponent housing.

Figure 8:
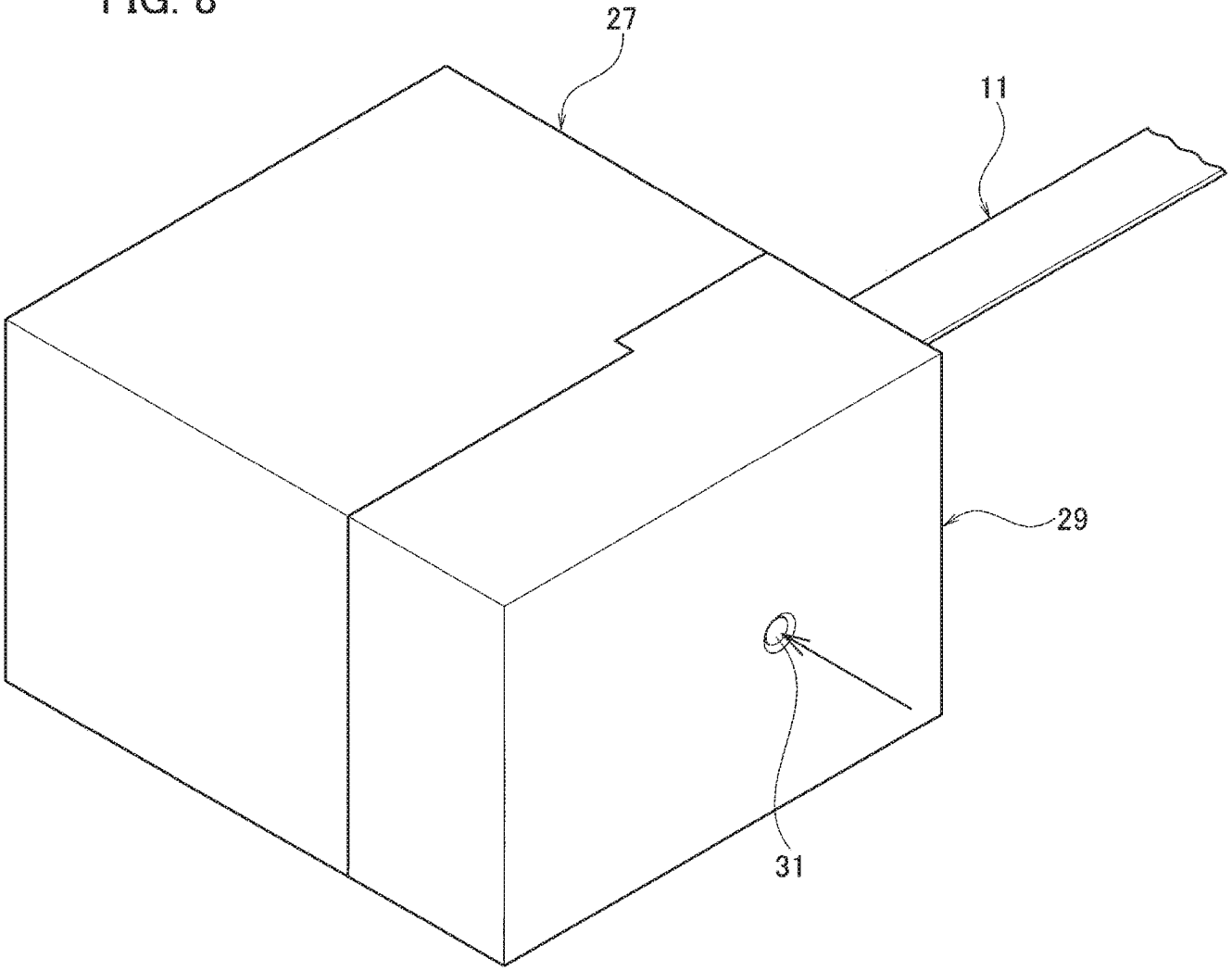
FIG. 8 is a perspective view showing a state where performing injection molding with an elastic sealing material to the housing of the connector according to the first embodiment of the present invention.
Figure 9:
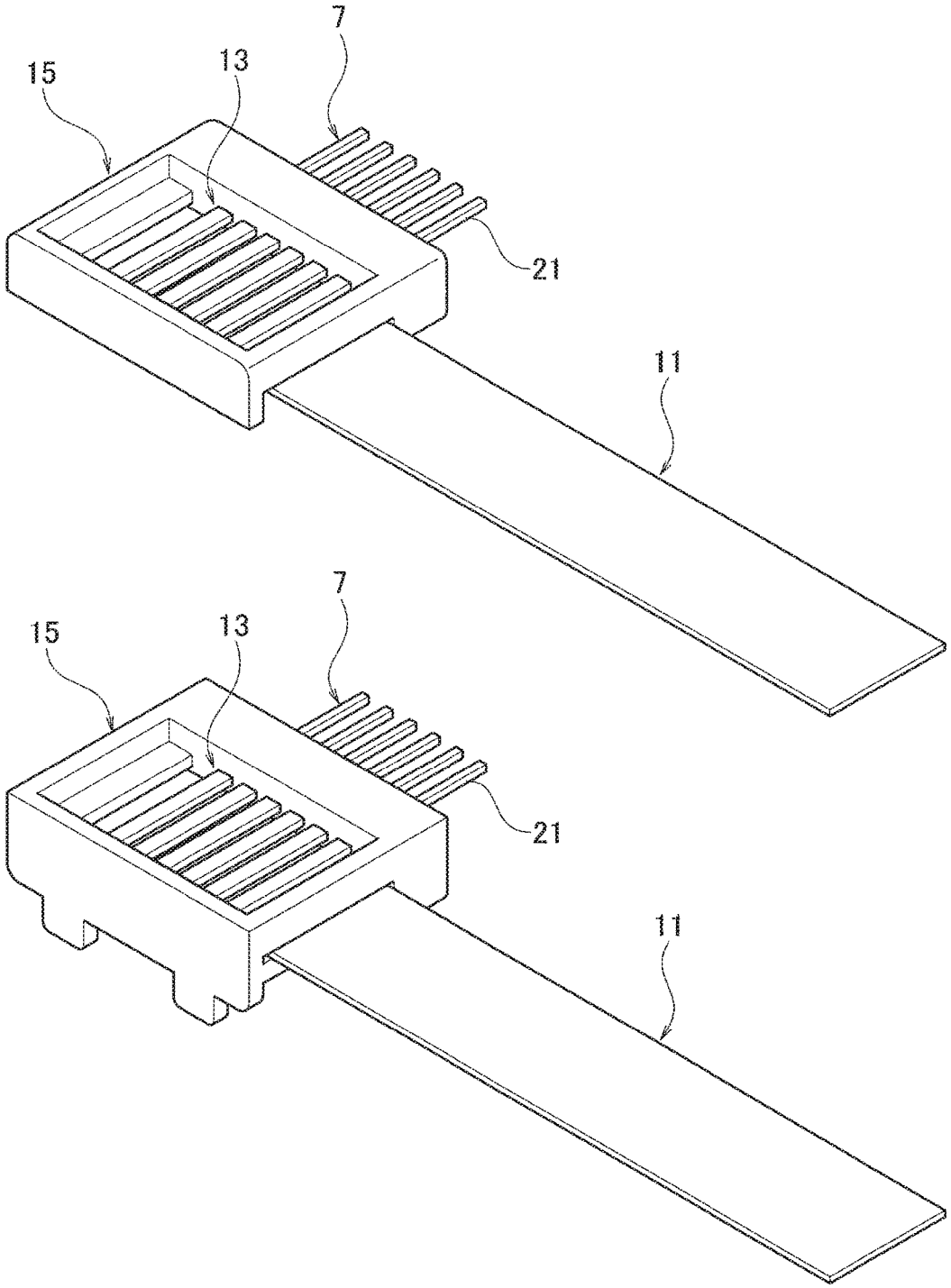
FIG. 9 is a perspective view showing a state where a flat cable is assembled to a holder of a connector according to a second embodiment of the present invention.
Figure 10:
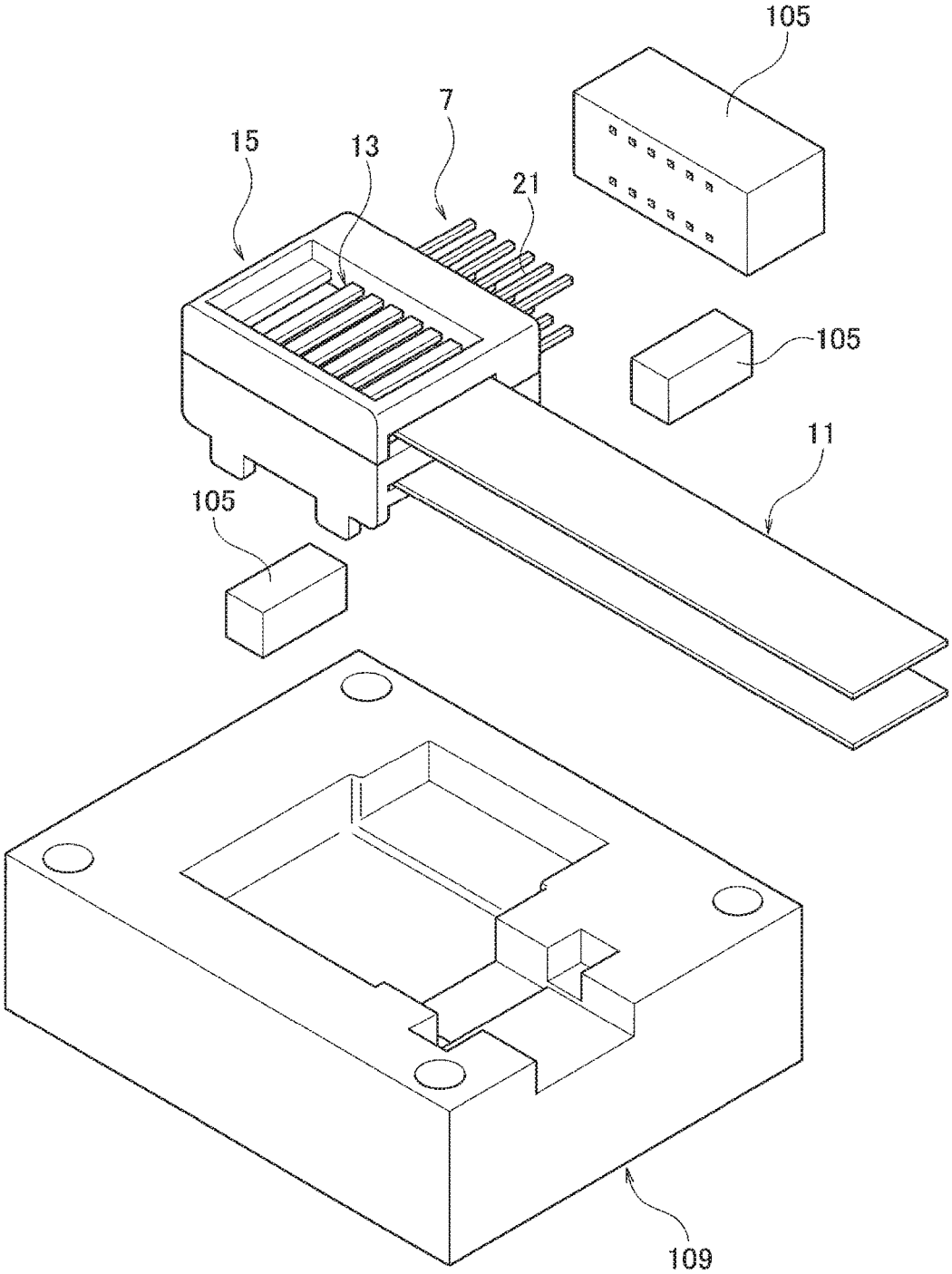
FIG. 10 is a perspective view showing a state where the holder of the connector according to the second embodiment of the present invention is disposed in a die.
Figure 11:
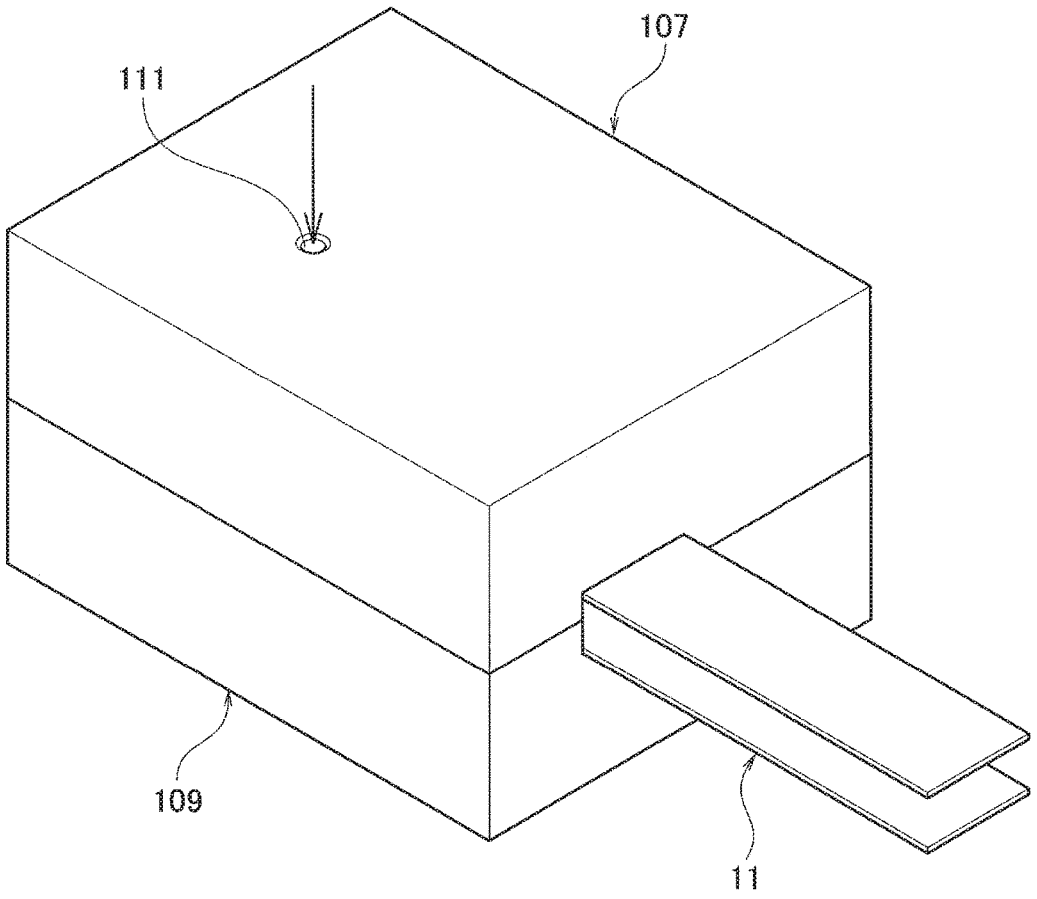
FIG. 11 is a perspective view showing a state where performing injection molding with a first sealing material to the holder of the connector according to the second embodiment of the present invention.
Figure 12:
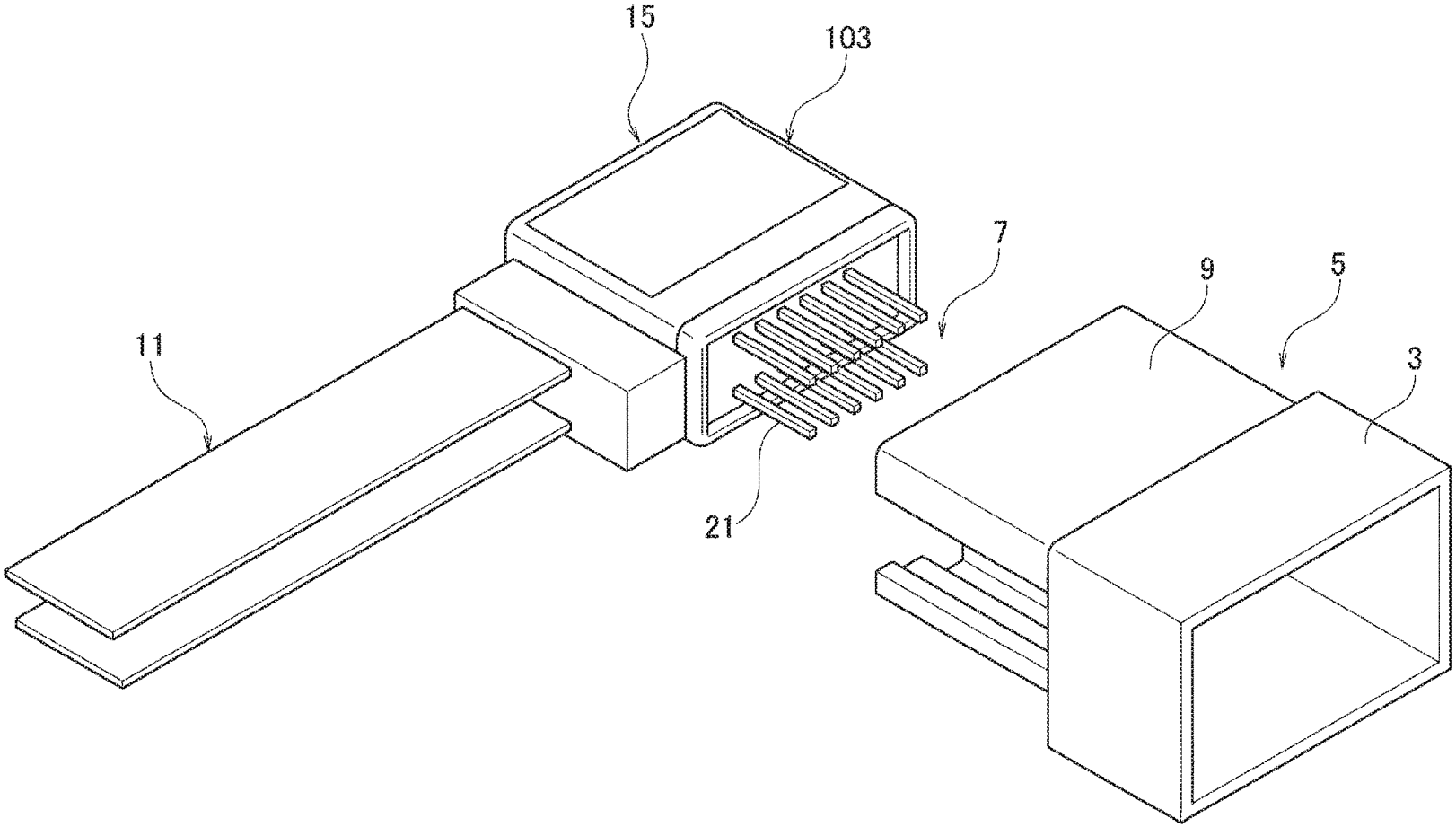
FIG. 12 is a perspective view showing a state where the holder is accommodated in the housing of the connector according to the second embodiment of the present invention.
Figure 13:
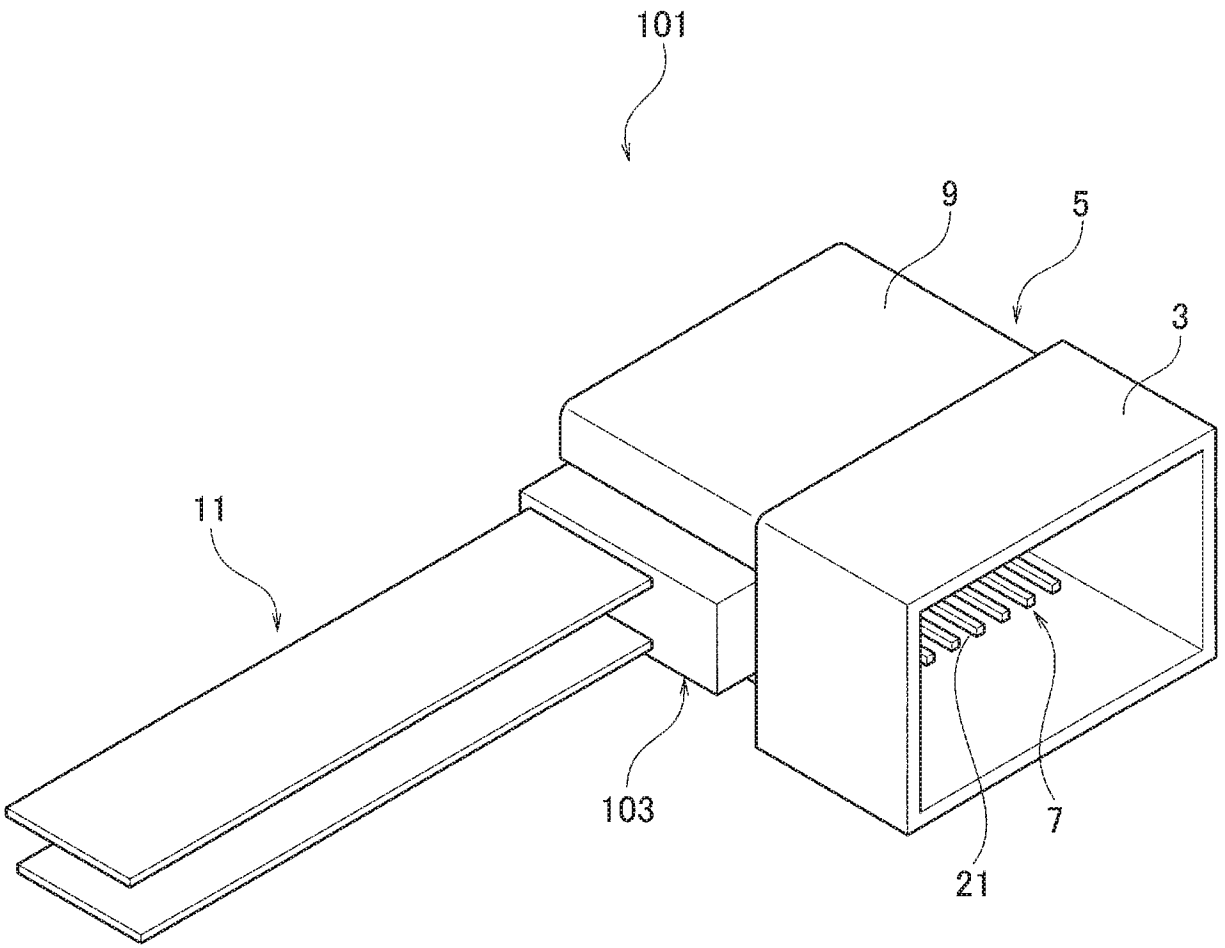
FIG. 13 is a perspective view showing a state where the holder is accommodated in the housing of the connector according to the second embodiment of the present invention.
Figure 14:
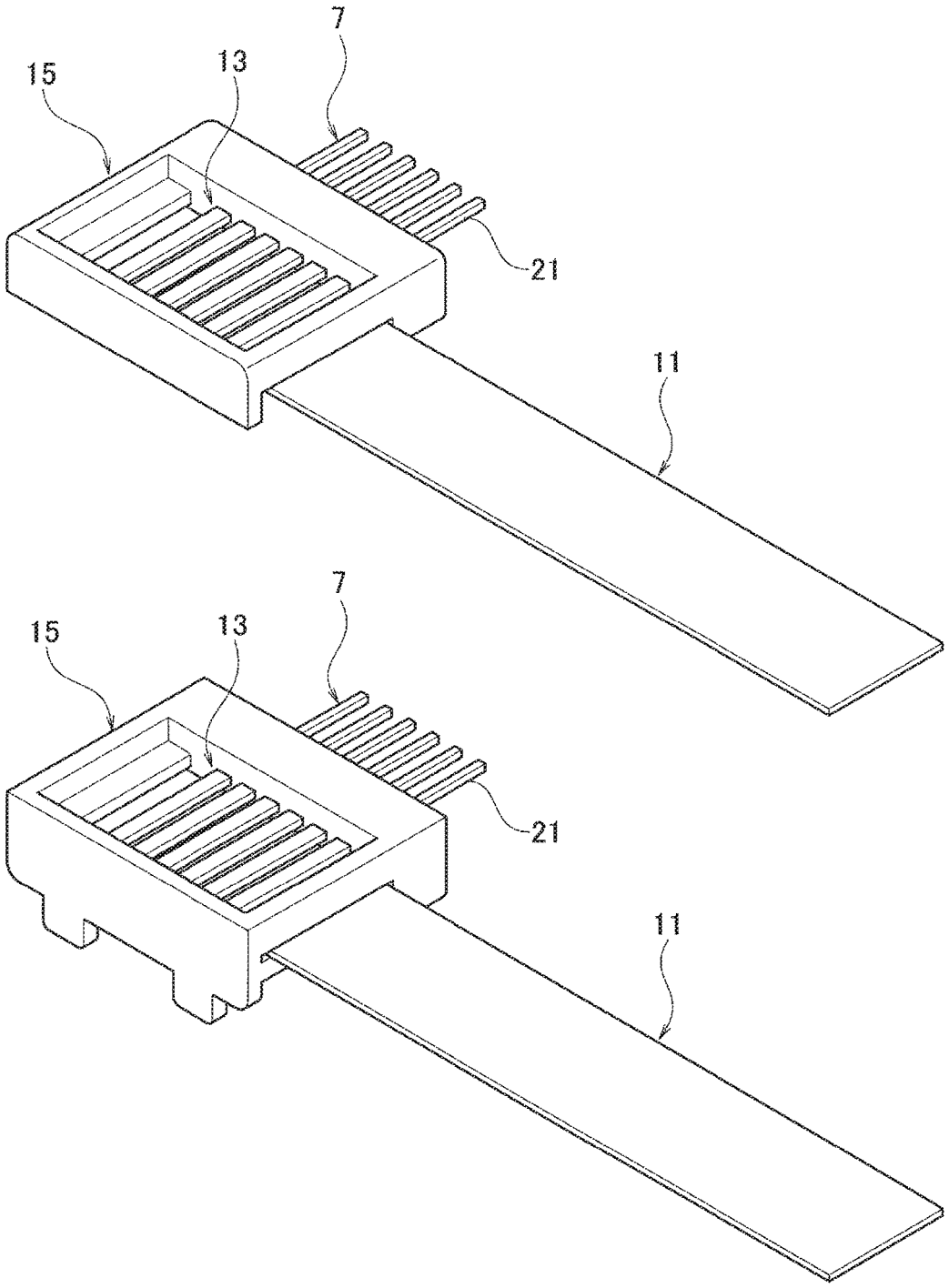
FIG. 14 is a perspective view showing a state where a flat cable is assembled to a holder of a connector according to a third embodiment of the present invention.
Figure 15:
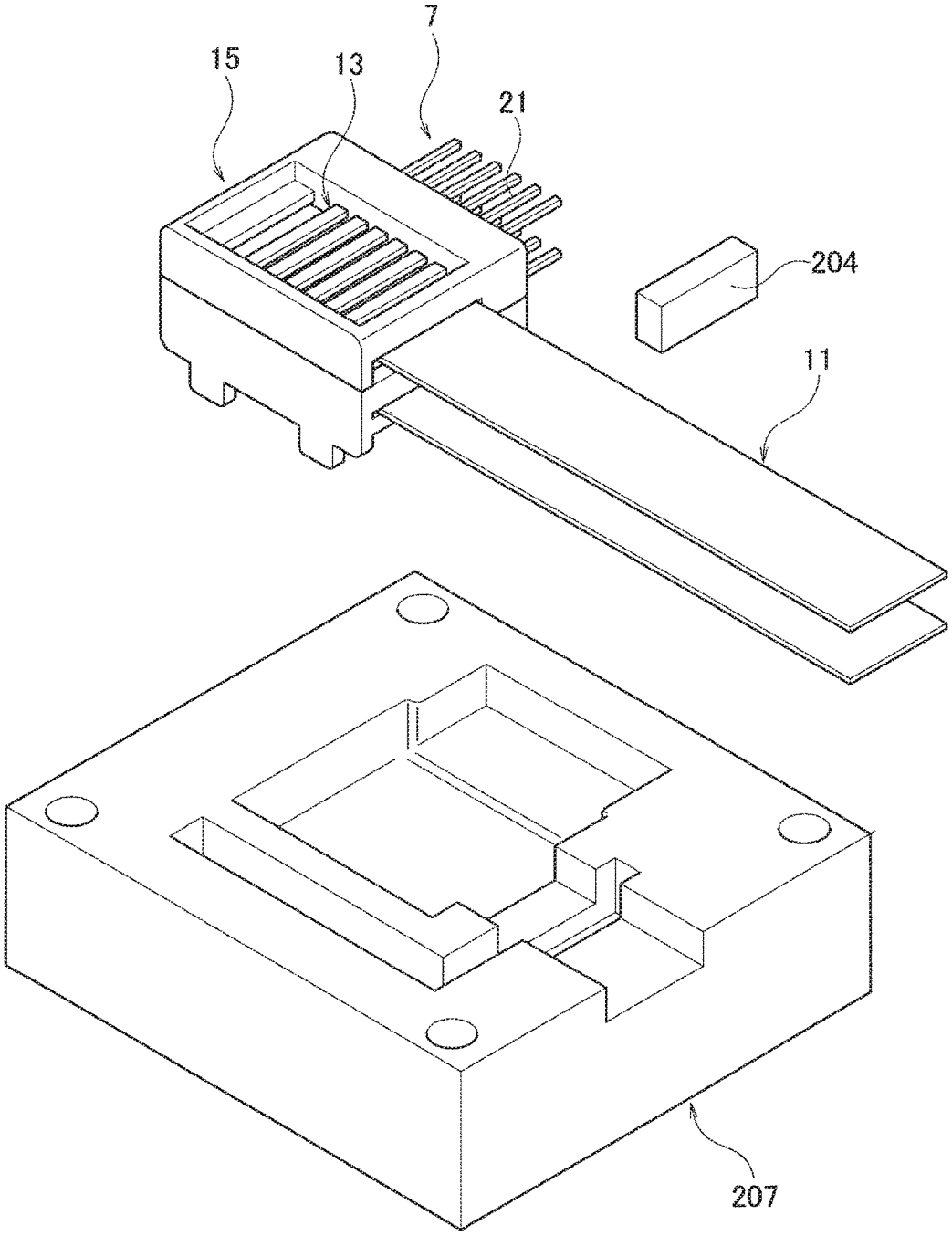
FIG. 15 is a perspective view showing a state where the holder of the connector according to the third embodiment of the present invention is arranged in a die.
Figure 16:
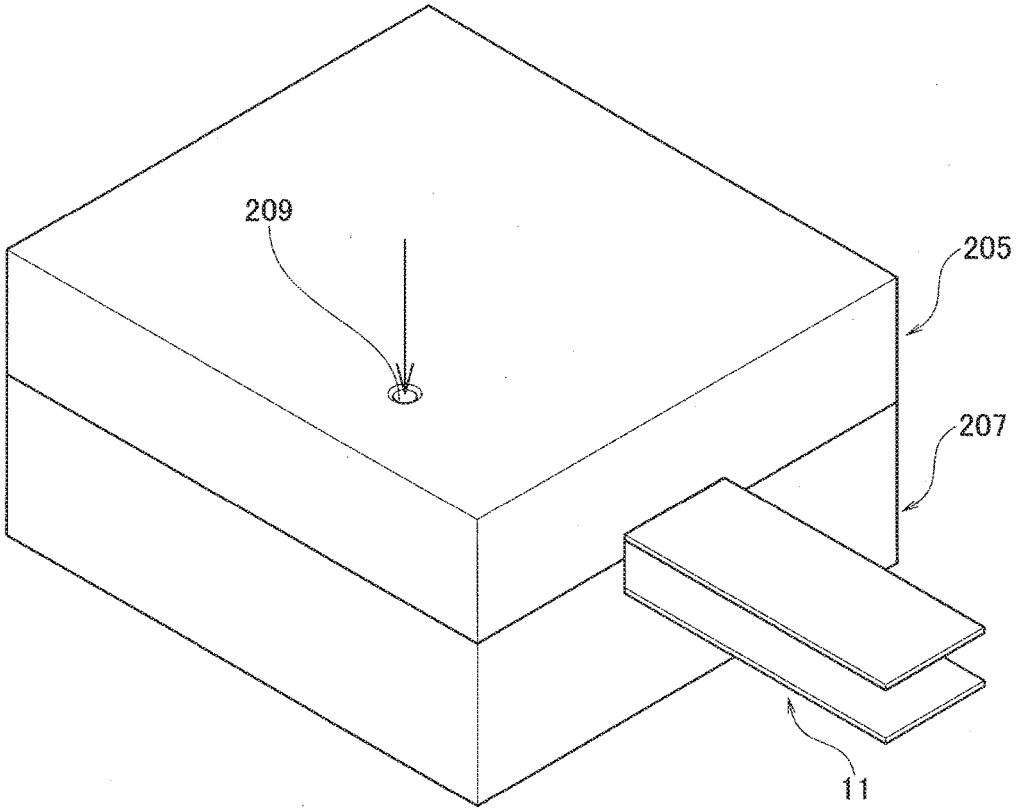
FIG. 16 is a perspective view showing a state where performing injection molding with a second sealing material to the flat cable of the connector according to the third embodiment of the present invention.
Figure 17:
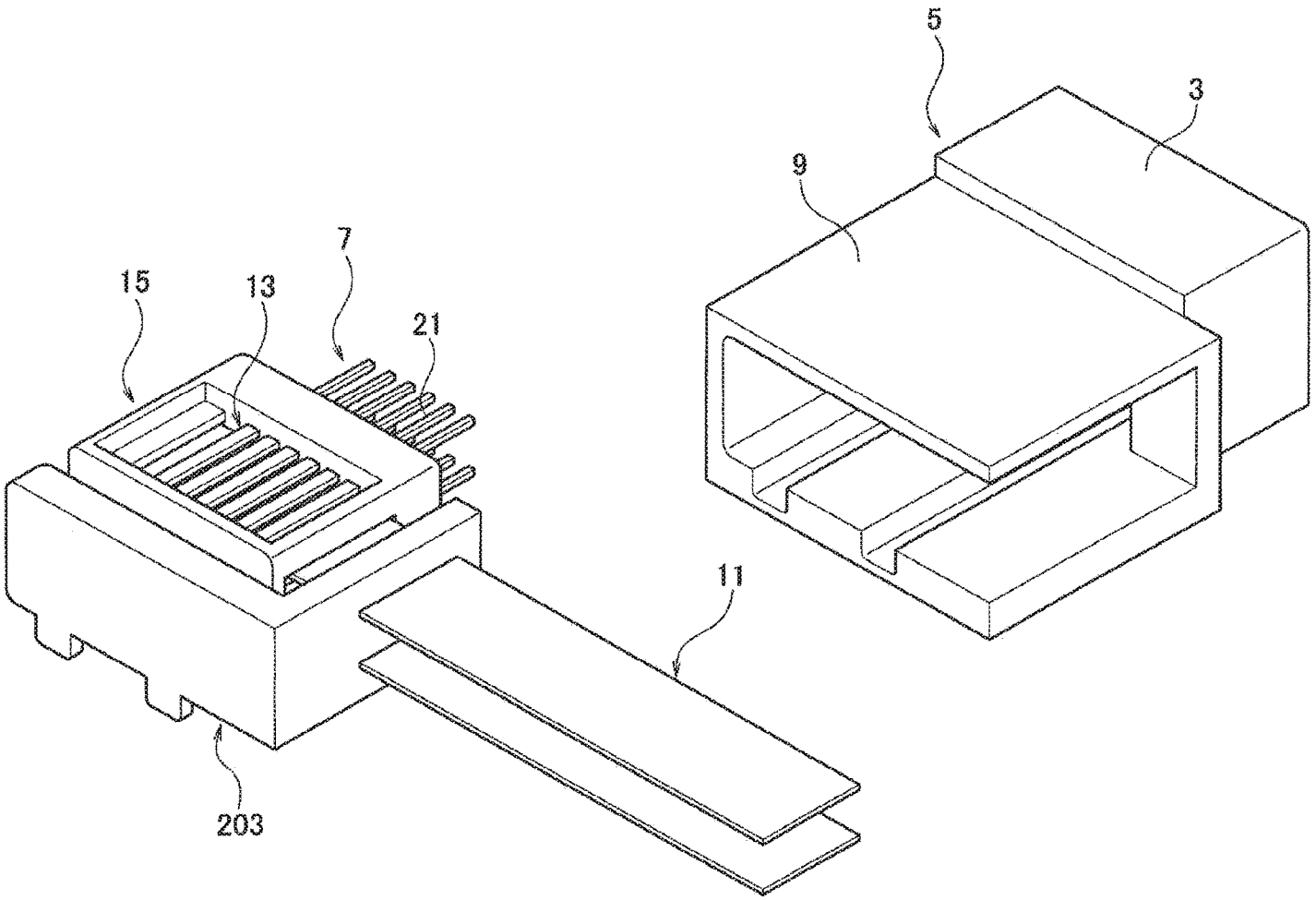
FIG. 17 is a perspective view snowing a state where the holder is accommodated in the housing of the connector according to the third embodiment of the present invention.
Figure 18:
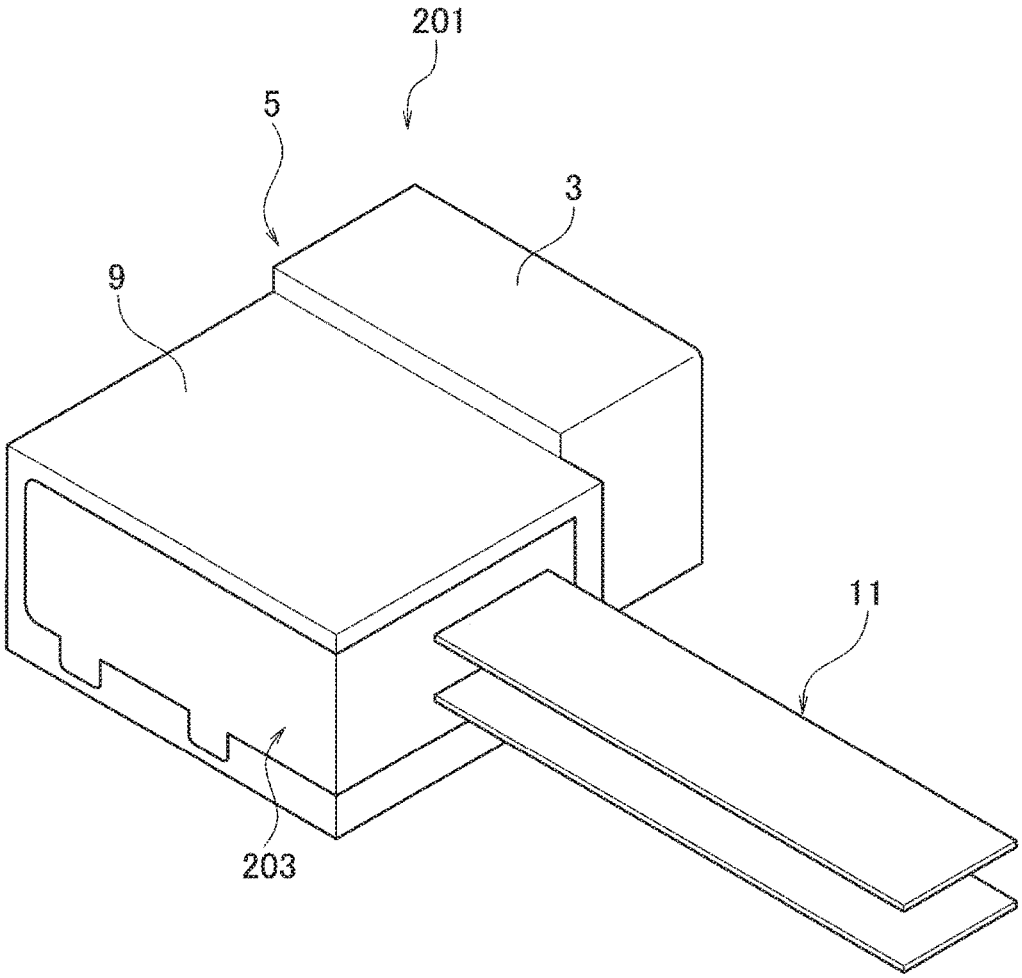
FIG. 18 is a perspective view showing a state where the holder is accommodated in the housing of the connector according to the third embodiment of the present invention.

The housing 5 in which the holders 15 are accommodated is set in the combined dies 27, 29 (see FIG. 8). Thereafter, by injection molding, the elastic sealing material 17 (see FIG. 1) filled in the drawing-out portion 9 of the housing 5 to close the opening of the drawing-out portion 9.

In the connector 101, the first sealing material 103 is located around the connection portion 13 in the holder 15, and integrally provided with the holder 15. The first sealing material 103 covers the connection portion. 13. Accordingly, it is possible to waterproof the connection portion 13 of the terminals 7 and the flat cable 11.

The first sealing material 103 is located around the holders 15, and is integrally provided with the holders 15. The first sealing material 103 collectively holds the holders 15. Therefore, the holders 15 can be treated as a single member, and it is possible to improve the assembling performance of the holders 15 to the housing 5.

In manufacturing method of the connector 101, the first sealing material 103 covering the connection portion 13 is integrally formed with the holder 15 around the connection portion in the holder 15. Accordingly, it is possible to securely waterproof the connection portion 13 of the terminals 7 and the flat cable 11.

The first sealing material 103 is located around the holders 15, and is integrally provided with the holders 15. Therefore, the holders 15 can be treated as a single member, and it is possible to improve the assembling performance of the holders 15 to the housing 5.

First Modification of Second Embodiment

A first modification of the second embodiment will be described with reference to FIGS. 9 to 13.

In the connector 101 according the present modification, the sealing material includes the first sealing material 103. The first sealing material 103 is formed to be capable of closing the drawing-out portion 9 and to be capable of being welded to the inner periphery of the drawing-out portion 9.

In a manufacturing method of the connector 101 according to the first modification, the first sealing material 103 covering the connection portion 13 and being capable of closing the drawing-out portion 9 and being welded to the inner periphery of the drawing-out portion 9, is integrally formed with the holder 15 around the connection portion 13 in the holder 15. The holder 15 is accommodated in the drawing-out portion 9 of the housing 5. The flat cable 11 is drawn out of the drawing-out portion 9 toward the outside of the housing 5 in the direction orthogonal to the fitting direction of the housing 5 and the opponent housing, and the first sealing material 103 is welded to the inner periphery of the drawing-out portion 9.

Note that the same reference numerals are used to designate the same components as those of the other embodiments, and the description of the configuration and the function will be omitted by referring to the description about the other embodiments. However, since the configuration is the same as that of the other embodiments, the effect thus obtained is the same.

The first sealing material 103 is made of insulating material such as synthetic resin or the like. By injection molding, the first sealing material 103 is integrally formed with the holders 15 around a part of the holders 15 where the connection portions 13 are located.

The stacked holders 15 are set in the combined dies 107, 109 together with cores 105. Thereafter, the first sealing material 103 is injected through the inlet 111 of the die 107, and is integrally molded (formed) with the stacked holders 15 around them.

The first sealing material 103 has an outer shape substantially corresponding to inner shape (inner space) of the drawing-out portion 9 to be capable of closing the drawing-out portion 9 in a state where the first sealing material 103 is accommodated in the drawing-out portion 9 of the housing 5. In addition, the first sealing material 103 is formed to be welded to the inner periphery of the drawing-out portion 9 by a welding means such as laser welding or the like.

With forming the first sealing material 103 as described above, the first sealing material 103 closes the opening of the drawing-out portion 9 in a state where the first sealing material 103 is accommodated in the drawing-out portion 9 of the housing 5. An outer periphery of the first sealing material 103 is welded to the inner periphery of the drawing-out portion 9 by a welding means such as laser welding or the like. Accordingly, the drawing-out portion 9 side of the housing 5 can be sealed by the first sealing material 103.

Accordingly, it is possible to give the first sealing material 103 the waterproof function which the elastic sealing material 17 (see FIG. 1) filled in the drawing-out portion 9 has, and to omit the elastic sealing material 17 and the process of filling the elastic sealing material 17.

In a manufacturing method of the connector 101 according to the first modification, firstly, the holders 15, in each of which the flat cable 11 is assembled and the predetermined terminal 7 and the predetermined conductor 6 (see FIG. 3) are connected to each other to form the connection portion 13, are stacked, and set in the combined dies 107, 109 together with the cores 105.

Next, by injection molding, the first sealing material 103 is injected around the connection portions 13 in the holders 15 to cover the connection portions 13 and is integrally formed with the holders 15 around the holders 15 to be capable of closing the drawing-out portion 9.

Next, the holders 15 with which the first sealing material 103 is integrally molded are inserted into and accommodated in the drawing-out portion 9 of the housing 5 in a state where the holders 15 are directed in the fitting direction of the housing 5 and the opponent housing, and the flat cables 11 are drawn out of the drawing-out portion 9 to the outside of the housing 5 in the direction orthogonal to the fitting direction of the housing 5 and the opponent housing.

Thereafter, the welding means such as laser welding is placed around the drawing-out portion 9 of the housing 5 in which the first sealing material 103 is accommodated. By use of the welding means, the outer periphery of the first sealing material 103 is welded to the inner periphery of the drawing-out portion 9, whereby the opening of the drawing-out portion 9 is closed by the first sealing material 103.

In the connector 101 according to the first modification, the sealing material includes the first sealing material 103, and the first sealing material 103 is formed to be capable of closing the drawing-out portion 9 and to be capable of being welded to the inner periphery of the drawing-out portion 9. Accordingly, it is possible to give waterproof functions of the housing 5 and the connection portion 13 to the sealing material, and to reduce the number of parts.

In the manufacturing method of the connector 101 according to the first modification, the first sealing material 103 covering the outer periphery of the holder 15 in which the connection portion 13 arranged is welded to the inner periphery of the drawing-out portion 9. Accordingly, it is possible to give waterproof functions of the housing 5 and the connection portion 13 to the sealing material, and to reduce the number of parts.

Second Modification of Second Embodiment

A second modification of the second embodiment will be described with reference to FIG. 9 to 13.

In the connector 101 according the present modification, the first sealing material 103 is formed to be capable of closing the drawing-out portion 9, and the flat cable 11 is drawn out of the drawing-out portion 9 to the outside of the housing 5 in the direction orthogonal to the fitting direction of the housing 5 and the opponent housing.

In a manufacturing method of the connector 101 according to the second modification, the first sealing material 103 covering the outer periphery of the holder 15 in which the connection portion 13 and being capable of closing the drawing-out portion 9 is integrally formed with the holder 15, the holder 15 is accommodated in the drawing-out portion 9 of the housing 5, and the flat cable 11 is drawn out of the drawing-out portion 9 to the outside of the housing 5 toward the direction orthogonal to the fitting direction of the housing 5 and the opponent housing.

Note that the same reference numerals are used to designate the same components as those of the other embodiments, and the description of the configuration and the function will be omitted by referring to the description about the other embodiments. However, since the configuration is the same as that of the other embodiments, the effect thus obtained is the same.

In the connector 101 according to the second embodiment, with filling the elastic sealing material 17 into the drawing-out portion 9 of the housing 5, the drawing-out portion 9 is closed and the drawing-out portion 9 side of the housing 5 is sealed.

In the connector 101 according to the first modification of the second embodiment, with welding the first sealing material 103 to the inner periphery of the drawing-out portion 9, the drawing-out portion 9 is closed and the drawing-out portion 9 side of the housing 5 is sealed.

In the connector 101 according to the aforementioned examples, the drawing-out portion 9 of the housing 5 is sealed. With this, the inside of the housing 5 is waterproofed, and the connection portion 13 of the terminals 7 and the flat cable 11 is prevented from water intrusion or the like.

Even if the water intrusion or the like wound be occurred, such water intrusion is not occurred in the connection portion 13 because the connection portion 13 is cover with the first sealing material 103.

Therefore, in the connector according to the second modification of the second embodiment, the first sealing material 103 is formed to be capable of closing the drawing-out portion 9, and is accommodated in the drawing-out portion 9, and the drawing-out portion 9 is closed by the first sealing material 103.

In a state where the drawing-out portion 9 is closed by the first sealing material 103, there is a possibility that water intrudes into the drawing-out portion 9.

However, the connection portion 13 is covered with the first sealing material 103. Therefore, the water intruding into the drawing-out portion 9 cannot reach the connection portion 13, and thus it is possible to maintain the connection reliability between the terminals 7 and the flat cable 11.

Even in the connector 101 according to the second modification, the flat cable 11 is drawn to the outside of the housing 5 in the direction orthogonal to the fitting direction of the housing 5 and the opponent housing.

By drawing the flat cable 11 in such manner, it is possible to place the terminals 7 across the conductors 6 (see FIG. 3) of the flat cable 11 in the connection portion 13.

With this, it is possible to connect a predetermined terminal of the terminals 7 and a predetermined conductor 6 of the conductors 6 of the flat cable 11 depending on the circuit design. Accordingly, it is possible to deal with complicated circuit designs and to further improve the free design of circuit.

In a manufacturing method of the connector 101 according to the second modification, firstly, the holders 15, in each of which the flat cable 11 is assembled and the predetermined terminal 7 and the predetermined conductor 6 are connected to each other to form the connection portion 13, are stacked, and set in the combined dies 107, 109 together with the cores 105.

Next, by injection molding, the first sealing material 103 is injected around the connection portions 13 in the holders 15 to cover the connection portions 13 and is integrally formed with the holders 15 around the holders 15 to be capable of closing the drawing-out portion 9.

Next, the holders 15 with which the first sealing material 103 is integrally molded are inserted into and accommodated in the drawing-out portion 9 of the housing 5 in a state where the holders 15 are directed in the fitting direction of the housing 5 and the opponent housing, and the opening of the drawing-out portion 9 is closed with the first sealing material 103.

Next, the flat cables 11 are drawn out of the drawing-out portion 9 to the outside of the housing 5 in the direction orthogonal to the fitting direction of the housing 5 and the opponent housing.

In the connector 101 according the second modification, the first sealing material 103 is formed to be capable of closing the drawing-out portion 9. Accordingly, it is possible to securely waterproof the connection portion 13 while water intrusion or the like to the drawing-out portion 9 of the housing 5 is suppressed.

The flat cable 11 is drawn out of the drawing-out portion 9 to the outside of the housing 5 in the direction orthogonal to the fitting direction of the housing 5 and the opponent housing. Accordingly, it is possible to place the terminals 7 across the conductors 6 of the flat cable 11 in the connection portion 13.

With this, it is possible to connect a predetermined terminal of the terminals 7 and a predetermined conductor 6 of the conductors 6 of the flat cable 11 depending on the circuit design. Accordingly, it is possible to deal with complicated circuit designs and to further improve the free design of circuit.

In the manufacturing method of the connector 101 according to the second modification, the holder 15 with which the first sealing material 103 is integrally formed is accommodated in the drawing-out portion 9 of the housing 5, and the flat cable 11 drawn out of the drawing-out portion 9 to the outside of the housing 5 in the direction orthogonal to the fitting direction of the housing 5 and the opponent housing. Accordingly, it is possible to obtain the waterproof performance of the connection portion 13, and to improve the free design of circuit.

Third Embodiment

A third embodiment will be described with reference to FIGS. 14 to 18.

In a connector 201 according to the present embodiment, a second sealing material 203 is located around the flat cable 11, and is integrally provided with the flat cable 11. The second sealing material 203 is formed to be capable of closing the drawing-out portion 9 and to be capable of being welded to the inner per of the drawing-out portion 9.

The flat cables 11 are drawn out of the drawing-out portion 9 to the outside of the housing 5. The second sealing material 203 is located around the flat cables 11, and is integrally provided with the flat cables 11 to hold the flat cables 11.

In a manufacturing method of the connector 201, before the holders 15 are accommodated in the drawing-out portion 9, the second sealing material 203, which is capable of closing the drawing-out portion 9 and is capable of being welded to the inner periphery of the drawing-out portion 9, is integrally formed with the flat cable 11. Further, before the elastic sealing material 17 is filled in the drawing-out portion 9, the second sealing material 203 is welded to the inner periphery of the drawing-out portion 9.

In addition, before the connection portion 13 is formed, the flat cables 11 are arranged in the holders 15. Thereafter, a predetermined terminal 7 of the terminals 7 and a predetermined conductor 6 of the conductors 6 of the flat cable 11 are connected with each other to form the connection portion 13. Before the holders 15 are accommodated in the drawing-out portion 9, the second sealing material 203 integrally formed with the flat cables around the flat cables 11.

Note that the same reference numerals are used to designate the same components as those of the other embodiments, and the description of the configuration and the function will be omitted referring to the description about the other embodiments. However, since the configuration is the same as that of the other embodiments, the effect thus obtained is the same.

As shown in FIGS. 14 to 18, the plural (e.g. two) holders 15 are accommodated in the drawing-out portion 9 of the housing 5 while the holders 15 are stacked.

In each holder 15, the plural (e.g. six) terminals 7 are arranged in parallel and the middle portions of them are integrally molded (formed) with the holder 15 by insert molding.

The flat cable 11 is arranged in each holder 15 which is integrally provided with terminals 7. While the holders 15 are accommodated in the drawing-out portion 9 of the housing 5, plural (e.g. two) flat cables 11 are drawn out of the drawing-out portion 9.

In a state where the holders 15 are stacked to each other, the second sealing material 203 is integrally provided with the flat cables 11 around the flat cables 11 near the holders 15.

The second sealing material 203 is made of insulating material such as synthetic resin or the like. By injection molding, the second sealing material 203 is integrally formed with the flat cables 11 around the flat cables 11 near the holders 15.

The stacked holders 15 are set in the combined dies 205, 207 together with cores 204. Thereafter, the second sealing material 203 is injected through an inlet 209 of the die 205, and is integrally molded (formed) with the flat cables 11 around them.

The second sealing material 203 is formed into an L-shape, for example. The second sealing material 203 includes an outer shape substantially corresponding to inner shape (inner space) of the drawing-out portion 9 to be capable of closing the opening of the drawing-out portion 9 of the housing 5. In a state where the second sealing material 203 is accommodated in the drawing-out portion 9 of the housing 5, an outer periphery of the second sealing material 203 is welded to the inner periphery of the drawing-out portion 9 by a welding means such as laser welding or the like.

With welding the second sealing material 203 to the inner periphery of the drawing-out portion 9, the drawing-out portion 9 can be doubly closed by the second sealing material 203 as well as the elastic sealing material 17 (see FIG. 1). That is, it is possible to further improve the waterproof performance.

The second sealing material 203 is located around the flat cables 11 arranged in the stacked holders 15, and is integrally provided with the flat cables 11. Therefore, the holders 15 can be as a single member, the holders 15 can be collectively accommodated in the drawing-out portion 9 of the housing 5, and it is possible to improve the assembling performance of the holders 15 and the flat cables 11 to the housing 5.

In a manufacturing method of the connector 201, the holders 15, in each of which the flat cable 11 is assembled and the predetermined terminal 7 and the predetermined conductor 6 (see FIG. 3) are connected to each other to form the connection portion 13, are stacked, and set in the combined dies 205, 207 together with the cores 204.

Next, by injection molding, the second sealing material 203 is injected around the flat cables 11 near the holders 15 to cover the flat cables 11, and is integrally formed with the flat cables 11 around the flat cables 11 to be capable of closing the drawing-out portion 9.

Next, the holders 15 in which the flat cables 11 are arranged are inserted into and accommodated in the drawing-out portion 9 of the housing 5 in a state where the holders 15 are directed in the fitting direction of the housing 5 and the opponent housing, and the flat cables 11 are drawn out of the drawing-out portion 9 to the outside of the housing 5 in the direction orthogonal to the fitting direction of the housing 5 and the opponent housing.

Next, the welding means such as laser welding is placed around the drawing-out portion 9 of the housing 5 in which the second sealing material 203 is accommodated. By use of the welding means, the outer periphery of the second sealing material 203 is welded to the inner periphery of the drawing-out portion 9.

The housing in which the holders 15 are accommodated is set in the combined dies 27, 29 (see FIG. 8). Thereafter, by injection molding, the elastic sealing material 17 (see FIG. 1) is filled in the drawing-out portion 9 of the housing 5 to close the opening of the drawing-out portion 9.

In the connector 201, the second sealing material 203, which is capable of closing the drawing-out portion 9 and is capable of being welded to the inner periphery of the drawing-out portion 9, is integrally provided with the flat cable 11 around the flat cable 11. Accordingly, it is possible to doubly waterproof the drawing-out portion 9 of the housing 5 with the second sealing material 203 as well as the elastic sealing material 17, whereby improving the waterproof performance.

The second sealing material 203 is located around the flat cables 11 and is integrally provided with the flat cables 11. That is, the second sealing material 203 collectively holds the flat cables 11. Therefore, the holders 15 can be treated as a single member, and it is possible to improve the assembling performance of the flat cables 11 to the housing 5.

In the manufacturing method of the connector 201, before the elastic sealing material 17 is filled in the drawing-out portion 9, the second sealing material 203 is welded to the inner periphery of the drawing-out portion 9. Accordingly, it is possible to doubly waterproof the drawing-out portion 9 of the housing 5 with the second sealing material 203 as well as the elastic sealing material 17, whereby improving the waterproof performance.

The second sealing material 203 is located around the flat cables 11, and is integrally provided with the flat cables 11. Therefore, the holders 15 can be treated as a single member, and it is possible to improve the assembling performance of the flat cables 11 to the housing 5.

Modification of Third Embodiment

A modification of the third embodiment will be described with reference to FIGS. 14 to 18.

In the connector 201 according the present modification, the sealing material includes the second sealing material 203.

In a manufacturing method of the connector 201 according to the present modification, the second sealing material 203, which is capable of closing the drawing-out portion 9 and is capable of being welded to the inner periphery of the drawing-out portion 9, is integrally formed with the flat cable 11 around the flat cable 11. The holders 15 are accommodated in the drawing-out portion 9. The flat cable 11 is drawn out of the drawing-out portion 9 toward the outside of the housing 5 in the direction orthogonal to the fitting direction the housing 5 and the opponent housing, and the second sealing material 203 is welded to the inner periphery of the drawing-out portion 9.

Note that the same reference numerals are used to designate the same components as those of the other embodiments, and the description of the configuration and the function will be omitted by referring to the description about the other embodiments. However, since the configuration is the same as that of the other embodiments, the effect thus obtained is the same.

In the connector 201 according the present modification, an outer periphery of the second sealing material 203, which is integrally molded with the outer periphery of the flat cable 11, is welded to the inner periphery of the drawing-out portion 9 by a welding means such as laser welding or the like. With this welding, the opening of the drawing-out portion 9 is closed and the drawing-out portion 9 side of the housing 5 is sealed. However, the elastic sealing material 17 (see FIG. 1) is not filled in the drawing-out portion 9

That is, the drawing-out portion 9 of the housing 5 is hermetically sealed only by the second sealing material 203, and the elastic sealing material 17 is omitted. Accordingly, it is possible to omit the process of filling the elastic sealing material 17.

In a manufacturing method of the connector 201 according to the present modification, the holders 15, in each of which the flat cable 11 is assembled and the predetermined terminal 7 and the predetermined conductor 6 (see FIG. 3) are connected to each other to form the connection portion 13, are stacked, and set in the combined dies 205, 207 together with the cores 104 while the flat cables 11 are arranged in the holders 15.

Next, by injection molding, the second sealing material 203 is injected around the flat cables 11 near the holders 15 to cover the flat cables 11, and is integrally formed with the flat cables 11 around the flat cables 11 to be capable of closing the drawing-out portion 9.

Next, the holders 15 in which the flat cables 11 are arranged are inserted into and accommodated in the drawing-out portion 9 of the housing 5 in a state where the holders 15 are directed in the fitting direction of the housing 5 and the opponent housing, and the flat cables 11 are drawn out of the drawing-out portion 9 to the outside of the housing 5 in the direction orthogonal to the fitting direction of the housing 5 and the opponent housing.

Next, the welding means such as laser welding is placed around the drawing-out portion 9 of the housing 5 in which the second sealing material 203 is accommodated. By use of the welding means, the outer periphery of the second sealing material 203 is welded to the inner periphery of the drawing-out portion 9

In the connector 201 according to the present modification, the sealing material includes the second sealing material 203. Accordingly, without arranging another sealing material as a separate member from the second sealing material 203 in the drawing-out portion 9, the second sealing material 203 is arranged in the drawing-out portion 9. Accordingly, only by welding the second sealing material 203 to the drawing-out portion 9, it is possible to waterproof the housing 5 and to reduce the number of parts.

In the manufacturing method of the connector 201 according to the present modification, the second sealing material 203, which is integrally formed with the flat cable 11, is welded to the inner periphery of the drawing-out portion 9. That is, Accordingly, without arranging another sealing material as a separate member from the second sealing material 203 in the drawing-out portion 9, the second sealing material 203 is arranged in the drawing-out portion 9. Accordingly, only by welding the second sealing material 203 to the drawing-out portion 9, it is possible to waterproof the housing 5 and to reduce the number of parts.

In the connector according to the embodiments of the present invention, one holder or two holders are accommodated in the drawing-out portion of the housing. However, the present invention is not limited to this, and three or more holders may be accommodated in the drawing-out portion of the housing.

In addition, one flat cable is arranged for one holder. However, the present invention is not limited to this. For example, plural terminals may be arranged in multiple stages with respect to one holder, and plural flat cables may be arranged thereto.

Further, one terminal is placed across a plurality of conductor portions of one flat cable. However, the present invention is not limited to this. For example, even in the case where the flat cable is a plurality of electric wires, the present invention can be applied by disposing one terminal to straddle the plurality of electric wires.

Further, the first sealing material is integrally provided on the outer periphery of the holders. However, the present invention is not limited to this, and the first seal member may be integrally provided on the outer periphery of one holder.

Further, the second sealing material is integrally provided on the outer periphery of the plurality of flat plate-like cables. However, the present invention is not limited to this, and the second sealing material may be integrally provided on the outer periphery of one flat cable.

In addition, the first sealing material and the second sealing material are provided independently from each other. However, the present invention is not limited to this, and the first sealing material and the second sealing material may be provided together.

What is claimed is:

1. A connector comprising:

a housing comprising a fitting portion capable of being fitted with an opponent housing;

at least one terminal accommodated in the housing, one end side of the at least one terminal being arranged in the fitting portion;

at least one flat cable drawn out of a drawing-out portion of the housing, provided with conductors connected to the other end side of the at least one terminal, the conductors being formed along a longitudinal direction of the at least one flat cable and arranged in a width direction of the at least one flat cable; and at least one holder integrally provided with the at least one terminal on the other end side of the terminal, accommodated in the drawing-out portion, in which a connection portion of the at least one terminal and the at least one flat cable is arranged, wherein the at least one flat cable is drawn out of the drawing-out portion in a direction orthogonal to a fitting direction in which the housing and the opponent housing are fitted with each other, the at least one terminal is placed across the conductors at the connection portion, the drawing-out portion is closed with a sealing material through which the at least one flat cable is inserted, the sealing material is integrally provided with an inner periphery of the drawing-out portion and an outer periphery of the at least one flat cable, the sealing material covers the connection portion and is integrally provided with the at least one holder around the connection portion in the at least one holder, the at least one holder comprises a plurality of holders accommodated in the drawing-out portion, and the sealing material is integrally provided with the plurality of holders around the plurality of holders to hold the plurality of holders.

2. The connector according to claim 1, wherein the at least one terminal comprises a plurality of terminals arranged in the at least one holder, and the sealing material is disposed between adjacent terminals of the plurality of terminals.

3. The connector according to claim 1, wherein the sealing material is formed to be capable of closing the drawing-out portion and to be capable of being welded to the inner periphery of the drawing-out portion.

4. The connector according to claim 1, wherein the sealing material is capable of being welded to the inner periphery of the drawing-out portion is integrally provided with the at least one flat cable around the at least one flat cable.

5. The connector according to claim 4, wherein the at least one flat cable comprises a plurality of flat cables drawn out of the drawing-out portion, and the sealing material is integrally provided with the plurality of flat cables around the plurality of flat cables to hold the plurality of flat cables.

6. The connector according to claim 1, further comprising:

a sealing member partitioning the housing into a side of the fitting portion; and a side of the drawing-out portion provided between the housing and the at least one holder.

7. A method of manufacturing a connector comprising: a housing comprising a fitting portion capable of being fitted with an opponent housing; at least one terminal accommodated in the housing, one end side of the at least one terminal being arranged in the fitting portion; a flat cable drawn out of a drawing-out portion of the housing, provided with conductors connected to the other end side of the at least one terminal, the conductors being formed along a longitudinal direction of the flat cable and arranged in a width direction of the flat cable; and a holder integrally provided with the at least one terminal on the other end side of the at least one terminal, accommodated in the drawing-out portion, in which a connection portion of the at least one terminal and the flat cable is arranged; the method comprising:

integrally forming the at least one terminal and the holder so that the one end side of the at least one terminal is exposed to an outside of the housing and the other end side of the at least one terminal is located in an inside of the housing;

arranging the flat cable into the holder so that the other end side of the at least one terminal is placed across the conductors;

connecting a predetermined terminal of the at least one terminal and a predetermined conductor of the conductors of the flat cable to form the connection portion;

accommodating the holder into the drawing-out portion of the housing;

drawing the flat cable out of the drawing-out portion toward the outside of the housing in a direction orthogonal to a fitting direction in which the housing and the opponent housing are fitted with each other;

integrally forming a sealing material with an inner periphery of the drawing-out portion and an outer periphery of the flat cable by filling the sealing material into the drawing-out portion to close the drawing-out portion; and integrally forming the sealing material with the holder around the connection portion in the holder, the sealing material covering the connection portion, wherein the holder comprises a plurality of holders accommodated in the drawing-out portion, and the sealing material is integrally provided with the plurality of holders around the plurality of holders to hold the plurality of holders.

8. A method of manufacturing a connector comprising: a housing comprising a fitting portion capable of being fitted with an opponent housing; at least one terminal accommodated in the housing, one end side of the at least one terminal being arranged in the fitting portion; a flat cable drawn out of a drawing-out portion of the housing, provided with conductors connected to the other end side of the at least one terminal, the conductors being formed along a longitudinal direction of the flat cable and arranged in a width direction of the flat cable; and a holder integrally provided with the at least one terminal on the other end side of the at least one terminal, accommodated in the drawing-out portion, in which a connection portion of the at least one terminal and the flat cable is arranged; the method comprising:

integrally forming the at least one terminal and the holder so that the one end side of the at least one terminal is exposed to an outside of the housing and the other end side of the at least one terminal is located in an inside of the housing;

arranging the flat cable into the holder so that the other end side of the at least one terminal is placed across the conductors;

connecting a predetermined terminal of the at least one terminal and a predetermined conductor of the conductors of the flat cable to form the connection portion;

integrally forming a sealing material with the holder around the connection portion in the holder, the sealing material covering the connection portion and being capable of closing the drawing-out portion and being welded to an inner periphery of the drawing-out portion;

accommodating the holder into the drawing-out portion of the housing;

drawing the flat cable out of the drawing-out portion toward the outside of the housing in a direction orthogonal to a fitting direction in which the housing and the opponent housing are fitted with each other; and welding the sealing material and the inner periphery of the drawing-out portion, wherein the holder comprises a plurality of holders accommodated in the drawing-out portion, and the sealing material is integrally provided with the plurality of holders around the plurality of holders to hold the plurality of holders.

9. A method of manufacturing a connector comprising: a housing comprising a fitting portion capable of being fitted with an opponent housing; at least one terminal accommodated in the housing, one end side of the at least one terminal being arranged in the fitting portion; a flat cable drawn out of a drawing-out portion of the housing, provided with conductors connected to the other end side of the at least one terminal, the conductors being formed along a longitudinal direction of the flat cable and arranged in a width direction of the flat cable; and a holder integrally provided with the at least one terminal on the other end side of the at least one terminal, accommodated in the drawing-out portion, in which a connection portion of the at least one terminal and the flat cable is arranged; the method comprising:

integrally forming the at least one terminal and the holder so that the one end side of the at least one terminal is exposed to an outside of the housing and the other end side of the at least one terminal is located in an inside of the housing;

arranging the flat cable into the holder so that the other end side of the at least one terminal is placed across the conductors;

connecting a predetermined terminal of the at least one terminal and a predetermined conductor of the conductors of the flat cable to form the connection portion;

integrally forming a sealing material with the flat cable around the flat cable, the sealing material covering the connection portion and being capable of closing the drawing-out portion and being welded to an inner periphery of the drawing-out portion;

accommodating the holder into the drawing-out portion of the housing;

drawing the flat cable out of the drawing-out portion toward the outside of the housing in a direction orthogonal to a fitting direction in which the housing and the opponent housing are fitted with each other; and welding the sealing material and the inner periphery of the drawing-out portion, wherein the holder comprises a plurality of holders accommodated in the drawing-out portion, and the sealing material is integrally provided with the plurality of holders around the plurality of holders to hold the plurality of holders.

* * * * *